US007013991B2

(12) United States Patent
Wilson-Langman et al.

(10) Patent No.: US 7,013,991 B2
(45) Date of Patent: Mar. 21, 2006

(54) OBSTACLE DETECTION SYSTEM FOR UNDERGROUND OPERATIONS

(75) Inventors: Alan Wilson-Langman, Milnerton (ZA); Michael R. Inggs, Simons Town (ZA); Leendert Johannes du Toit, Somerset-West (ZA); Kirankumar M. Kothari, Hoffman Estates, IL (US); David R. Hanson, Pella, IA (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 10/919,748

(22) Filed: Aug. 17, 2004

(65) Prior Publication Data

US 2005/0061547 A1 Mar. 24, 2005

Related U.S. Application Data

(60) Provisional application No. 60/505,674, filed on Sep. 24, 2003.

(51) Int. Cl.
*E21B 44/06* (2006.01)

(52) U.S. Cl. ..... 175/48; 175/40

(58) Field of Classification Search ..... 175/48, 175/26, 38, 42, 40, 50; 340/435, 436, 437
See application file for complete search history.

(56) References Cited

U.S. PATENT DOCUMENTS

| | | | | |
|---|---|---|---|---|
| 5,553,407 | A | 9/1996 | Stump | |
| 5,659,985 | A | 8/1997 | Stump | |
| 5,682,136 | A * | 10/1997 | Del Signore | 346/436 |
| 5,704,142 | A | 1/1998 | Stump | |
| 5,720,354 | A | 2/1998 | Stump et al. | |
| 5,819,859 | A | 10/1998 | Stump et al. | |
| 5,867,117 | A | 2/1999 | Gogineni et al. | |
| 5,904,210 | A | 5/1999 | Stump et al. | |
| 6,313,755 | B1 * | 11/2001 | Hetmaniak et al. | 340/856.3 |
| 6,755,263 | B1 * | 6/2004 | Alft et al. | 175/61 |

* cited by examiner

*Primary Examiner*—Frank S. Tsay
(74) *Attorney, Agent, or Firm*—Mark E. Fejer

(57) ABSTRACT

An obstacle avoidance system for obstacle detection in an opaque material. The system includes at least one electromagnetic signal source adapted to produce an electromagnetic source signal suitable for transmission through the opaque material, at least one electromagnetic signal detector adapted to receive reflected electromagnetic energy signals from discontinuities in the opaque material encountered by the electromagnetic source signal, and a reflected electromagnetic energy signal processor suitable for determining a presence of obstructions and/or strata variations within the opaque material. The system is preferably integral with a head element suitable for traversing the opaque material, for example a subterranean drill bit.

23 Claims, 19 Drawing Sheets

OBSTACLE DETECTION SYSTEM FOR UNDERGROUND OPERATIONS

CROSS-REFERENCE TO RELATED APPLICATION

This application claims the benefit of provisional U.S. patent application Ser. No. 60/505,674 having a filing date of Sep. 24 2003.

BACKGROUND OF THE INVENTION

1. Field of the Invention

This invention relates to an electromagnetic sensing device. More particularly, this invention relates to an electromagnetic sensing device suitable for avoiding subterranean obstacles such as utility pipelines during underground operations such as drilling. Although not so limited, the system is particularly suitable for use in connection with Horizontal Directional Drilling (HDD) machinery. The system allows for the detection of underground utilities at a distance sufficient to allow the drill to avoid these obstacles. Although particularly suitable for use in directional drilling operations, it may be used in any application where space is limited and sensing of objects in opaque materials is required. The electromagnetic sensor design is a novel implementation of a stepped frequency continuous ground penetrating radar system designed to fit inside the drill head of a horizontal directional drill or in other applications where space requirements are restrictive. The system comprises the electronics to generate and receive the radar signals, an adaptive antenna designed specifically for various soil conditions, communications and power electronics to allow the radar to be controlled via a single conductor in the drill-string and a human machine interface (HMI) that performs display, storage and processing functions.

In operation, the radar generates continuous wave frequencies over a 400 MHz to 1000 MHz bandwidth. This signal is applied to the terminals of an electronically matched antenna that radiates energy ahead of the drill string. The scattered energy from the object for each frequency is received by the radar sensor and converted to a digital signal. This data is calibrated and converted to a spatial domain and then transmitted to the HMI by means of the drill string. The HMI provides a simple A-scope radar interface that tracks the targets ahead of the drill. The HMI also interfaces with the drill hardware to allow for automatic shutdown of the drill if utilities or other objects are encountered in the drill path.

2. Description of Related Art

Guided directional drilling equipment is being used more and more frequently for the installation of underground utilities. These trenchless installations offer significant advantages over trenching operations, including ease of installation in inaccessible areas and lower costs. However, with this installation ease and lower cost, there is the potential hazard of cutting existing underground utilities and the significant cost incurred for repair and loss of service. Even with the use of surface locating technology and one call services, existing utilities are regularly cut. In 1993 there were more than 104,000 hits or third party damage to gas pipelines in the United States with a total cost exceeding $86 million. Even though not all these utility hits were the result of directional drilling operations, the magnitude of the problem is evident. Companies responsible for cuts are also being charged for revenue loss in addition to repair costs. Thus, to reduce the risk of utility damage, it is essential to develop new techniques, other than standard surface locating methods, to locate utilities in the path of and adjacent to new guided drill bores.

Other than standard pipe and cable locators, the most commonly applied geophysical technique for locating underground utilities is ground penetrating radar (GPR). Surveys are normally conducted from the surface and the location and depth of potential utilities are determined from an analysis of reflected energy. Other techniques that have been used include magnetic field sensors, seismic or acoustic techniques, and electromagnetic induction sensors. All these techniques are most commonly applied from the surface and, as such, provide no information on conditions in the immediate vicinity of the drill as drilling progresses. Errors in lateral and depth locations result in utility cuts, both as the drill advances and when the hole is subsequently reamed. According to users, most utility hits occur on the back ream. While utilities are missed as the pilot bore is drilled, they are close enough laterally that they are cut as the reamer is pulled back through the hole. Hence, any drill head technique needs to be able to look both ahead of the drill and to the side. This capability will enable avoidance of utilities directly in its path, both when the hole is initially drilled and when the hole is reamed during the product installation phase.

While not applicable in all soil types, GPR provides one of the fastest and most accurate determinations of object location of any geophysical sensing technique. This rapid data acquisition feature of GPR is essential, because with an advancing drill stem, obstacle avoidance information must be acquired and evaluated rapidly. Furthermore, a means of recording the location of utilities during drilling must be provided. In addition to providing immediate assistance, these data provide input for a database of as-built conditions of pre-existing utilities.

As important as high signal to noise ratio data collection is the presentation of data in a manner that is easily interpreted. Simultaneous rotation and advance of the drill string typically result in data that do not necessarily appear the same as that normally collected from surface surveys. Analyses of the expected returns of different utilities at different relative orientations is thus desirable. Because of the rapid advance rate, the drill operator must be able to identify and react to utilities quickly. Alternatively, the drill may be linked to interlock circuits that provide an automatic shutdown if utilities are approached too rapidly for operator intervention, thereby requiring processing and information display in real time.

SUMMARY OF THE INVENTION

It is, thus, one object of this invention to provide an apparatus for use in avoiding contact with underground obstacles.

It is another object of this invention to provide an object detection sensor suitable for use in conjunction with an underground cutting tool, such as a drilling apparatus.

It is yet another object of this invention to provide an apparatus for detecting an underground obstacle in the path of a drilling apparatus.

It is still a further object of this invention to provide an apparatus for detecting and enabling avoidance of underground obstacles which provides real-time processing and information display.

It is another object of this invention to provide an apparatus for detecting underground obstacles which enables rapid acquisition and evaluation of obstacle avoidance data.

These and other objects of this invention are addressed by an apparatus for obstacle detection in an opaque material comprising at least one electromagnetic signal source adapted to produce an electromagnetic source signal suitable for transmission through the opaque material, at least one electromagnetic signal detector adapted to receive reflected electromagnetic energy signals from discontinuities in the opaque material encountered by the electromagnetic source signal, a reflected electromagnetic energy signal processor suitable for determining a presence of obstructions and/or strata variations within the opaque material, and a head element, having a leading edge and a trailing edge, suitable for traversing at least a portion of the opaque material. The at least one electromagnetic signal source, the at least one electromagnetic signal detector and the at least one reflected electromagnetic energy signal processor are disposed in contact with or proximate to the head element.

The present invention is generally directed to an obstacle or object detection sensor suitable for incorporation in or proximate to an underground cutting tool. In accordance with one embodiment of this invention, one or more object detection sensors are provided in-situ and an underground cutting tool or portion of a drill stem connected thereto. The object detection sensors respectively produce an electromagnetic source signal which is transmitted from the cutting tool and propagates into the earth surrounding the cutting tool. The object detection sensors receive electromagnetic energy reflected from discontinuities in the ground medium encountered by the transmitted source signals. Such ground medium discontinuities typically indicate the presence of changes in geologic strata or underground objects, such as buried utilities.

The reflected signal content received by the object detection sensors is processed, whether partially or entirely, by circuitry provided within or proximate to the cutting tool. The processed data are used to determine the presence of obstructions and/or geologic strata variations within the sensitivity range of the in-situ object detection sensors. The processed signals may be used for a variety of purposes, such as modifying cutting tool movement to avoid contact with a detected subsurface object (e.g. a utility or unknown obstacle), identifying a detected object, and determining the location thereof. The processed signal may further be combined with other cutting tool sensor data (e.g. location, pitch, yaw, roll sensor data) to produce as-built mapping data corresponding to an actual path taken by the cutting tool.

According to one embodiment of the present invention, a single obstacle detection sensor may be used to detect objects proximate the cutting tool. The single sensor is positioned at a suitable location on the cutting tool so as to maximize the detection capability or sensitivity of the sensor. For example, the single sensor may be located proximate the leading edge of the cutting tool in a forward-looking orientation, on the cutting tool in a side looking orientation, or at a location that provides a balance between forward- and side looking orientations. Alternatively, the sensor may be located on the cutting tool body, but be so designed that it is sensitive to or receives signals back from objects ahead of or slightly to the side of the tool body.

According to another embodiment, multiple object detection sensors may be deployed at various locations within or on the cutting tool from which object detection data may be concurrently or selectively derived. For example, a first sensor may be positioned at a suitable location on the cutting tool so as to maximize the forward-looking capability or sensitivity of this sensor. A second sensor may be positioned at a suitable location on the cutting tool so as to maximize the side looking capability or sensitivity of this sensor. Additional sensors may be deployed in a forward- or side-looking orientation, or orientations having directivity between or differing from forward- and side-looking orientations to increase the detection capabilities of the object/obstacle detection system of the cutting tool. By way of example, multiple sensor elements may be used to enhance forward looking capabilities while reducing the sensor sensitivity to objects behind the cutting tool.

In accordance with one embodiment, the object/obstacle detection sensor suitable for use in or proximate an underground cutting tool includes an electromagnetic signal transmitter and receiver, which may be configured as a single transceiver, which operates in a frequency range generally associated with radar applications, such as known ground penetrating or probing radar applications. In this context, the electromagnetic signal transceiver may be viewed as a ground penetrating radar (GPR) circuit or system deployed within or proximate to a cutting tool, such as pilot hole and reamer cutting tools useful in the horizontal and vertical drilling industries.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
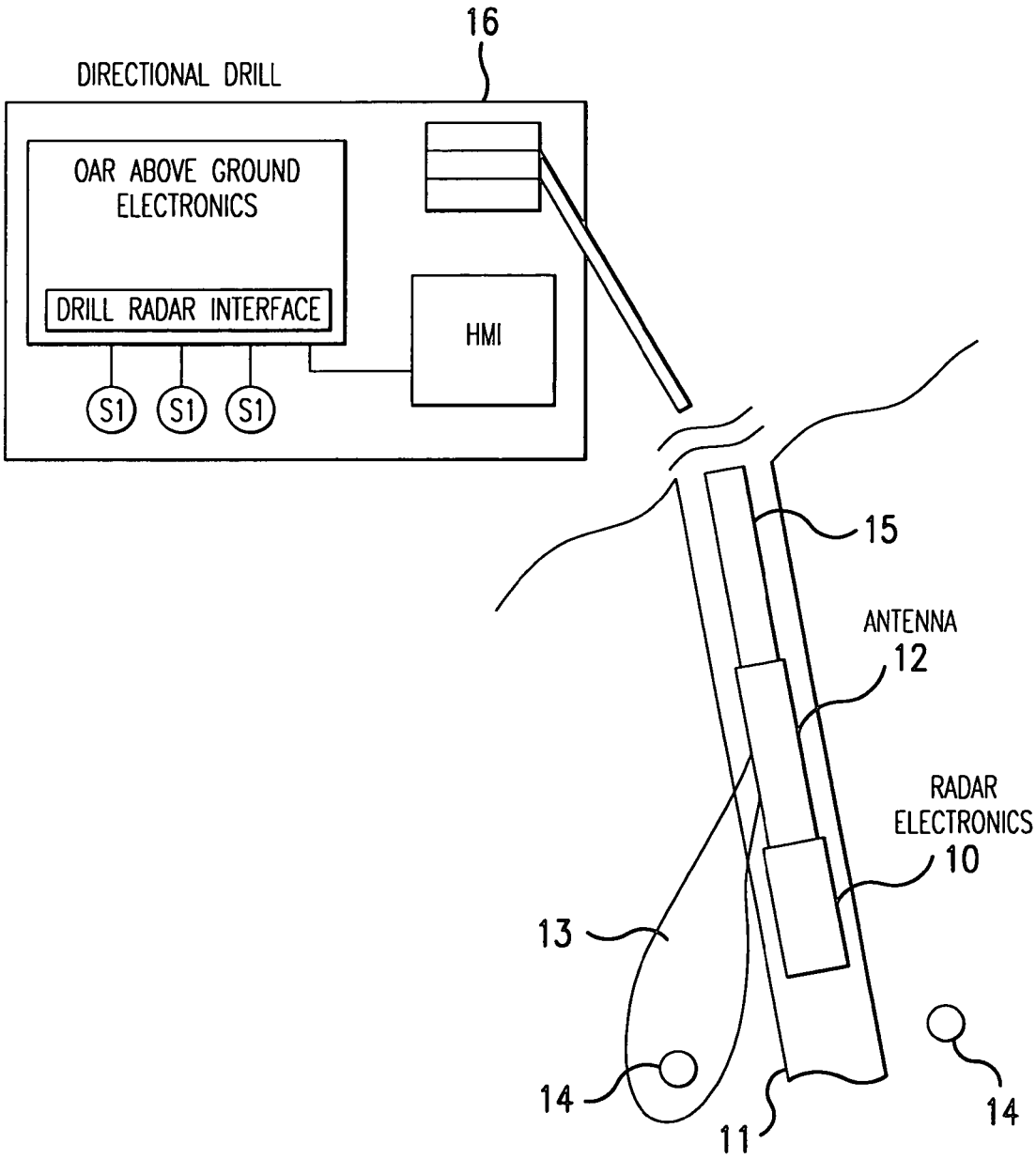
FIG. 1 is a conceptual diagram of the obstacle avoidance system of this invention.
Figure 2:
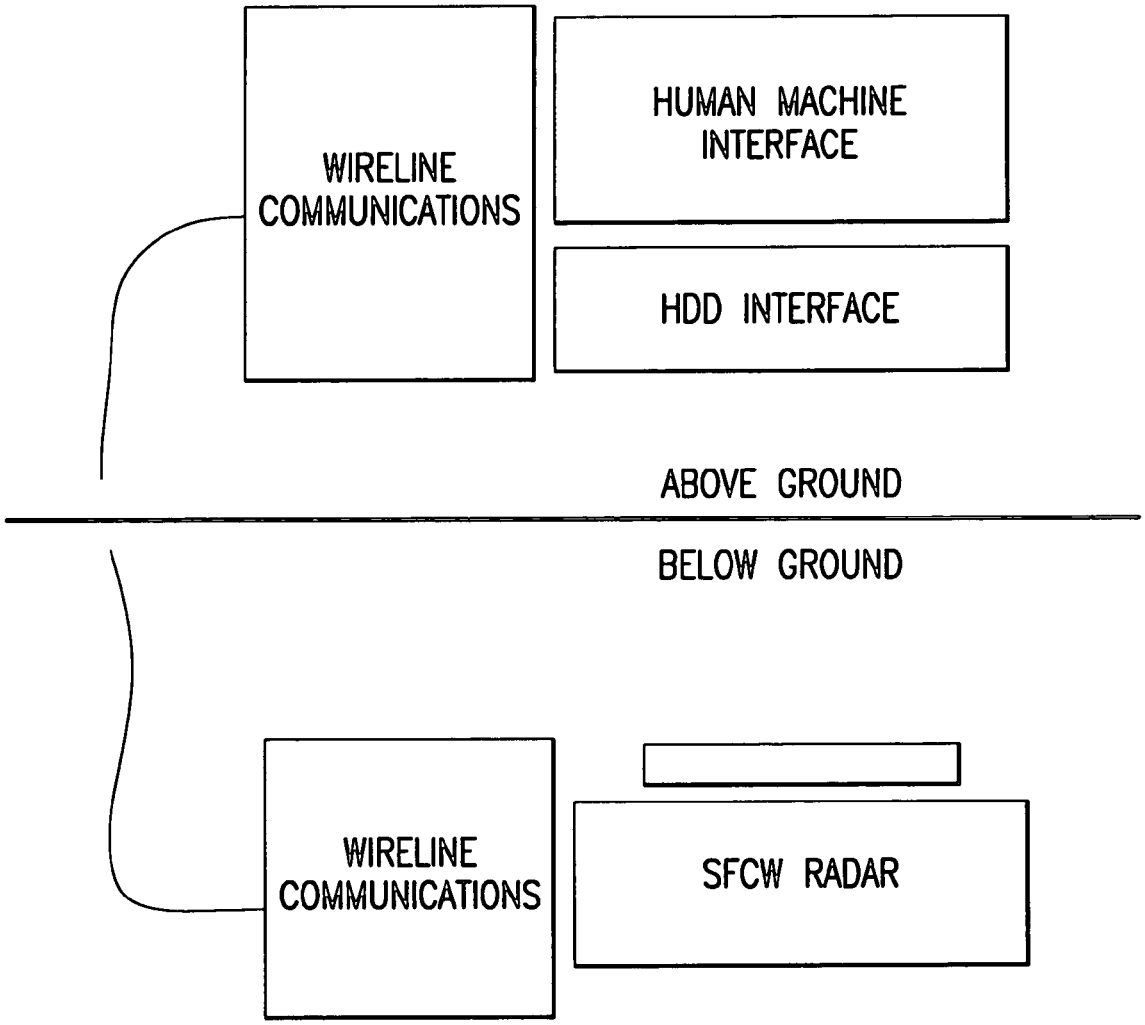
FIG. 2 is another conceptual diagram of the obstacle avoidance system of this invention.

FIGS. 1 and 2 show conceptual diagrams of the obstacle avoidance radar system (OAS) of this invention. The basic components of the system, shown in FIG. 2, comprise the radar technology, which is disposed in the ground, a human machine interface and an HDD interface, which are disposed above ground, a communications link connecting the radar technology with the human machine interface and HDD interface, which allows communications and power to share a single conductor, and an antenna 12 (FIG. 1). In accordance with one preferred embodiment of this invention, the communications link comprises wireline connections. However, communications between the below ground and above ground system components may also be accomplished by means of wireless transmission or other communications systems apparent to those skilled in the art.

The application shown in FIG. 1 is for directional drilling and comprises radar electronics 10 mounted in the drill head 11 of a directional drill. The radar electronics include a radar antenna 12, which illuminates the area in front of the drill, indicated by reference numeral 13, thereby enabling the radar to detect obstacles 14 ahead of the drill head 11. This information is then transmitted by means of the drill string 15 to processing hardware 16 which interfaces with the drill control electronics and can automatically shutdown the drill if an obstacle is detected.

In accordance with one embodiment of this invention, the antenna elements of radar antenna 12 comprise a forward radiating monopole antenna mounted on the body of the drill head or other cutting tool. This antenna is covered with a non-metallic protective material, preferably a hard dielectric material that allows passage of microwaves through the protective material. An exemplary material suitable for this application is KEVLAR, which is available from DuPont. Other dielectric materials, however, may also be used.

Figure 3:
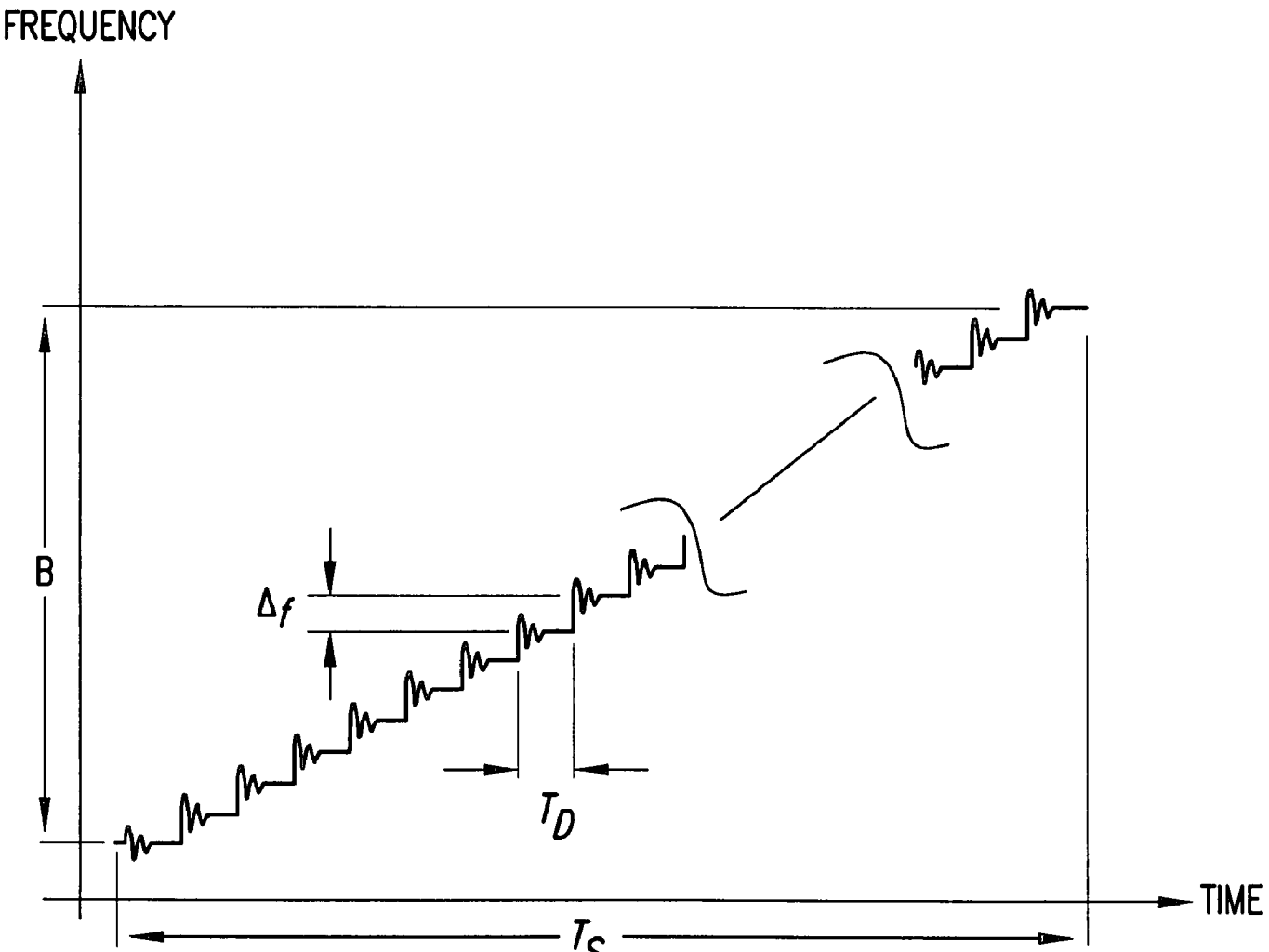
FIG. 3 is a diagram representative of a stepped frequency continuous wave waveform employed in the method of this invention.

In accordance with one particularly preferred embodiment of this invention, the radar is implemented using stepped frequency continuous wave (SFCW) radar technology, a well documented modulation technique. SFCW radar determines the distance to an obstacle by sequentially measuring the coherent electromagnetic returns from an obstacle for a number of stepped operating frequencies. FIG. 3 shows the waveform for N frequency steps and $T_D$ and $T_S$ are the frequency dwell time and measurement time for the radar waveform. The frequency dwell time is the sum of the time required for the frequency synthesizer to settle, the time required for the intermediate frequency (IF) filter to settle and the time to digitize the IF waveform for each radar channel. The SFCW transmitted waveform is a line spectrum with a frequency separation $\Delta f$ between the spectral lines. Applying Nyquist sampling criterion allows for unambiguous reconstruction of the waveform. The captured frequency data is then transformed into the spatial domain using windows Fast Fourier Transform. The antenna illuminates a directional beam ahead of the radar. As the drill rotates, the antenna illuminates a cone in front of the drill with a blind spot along the radar axis of less than 2 degrees. Utilities that enter this illumination region are tracked by the human machine interface software discussed in more detail herein below. Information regarding the utilities that are deemed at risk is communicated to the operator through a simple user interface on the HDD.

The radar includes calibration and antenna matching circuitry to allow the radar to actively match the antenna to different media. The radar is connected to the above ground human machine interface by way of electronics that allow a single conductor to carry both communications and power signals to the radar.

Figure 4:
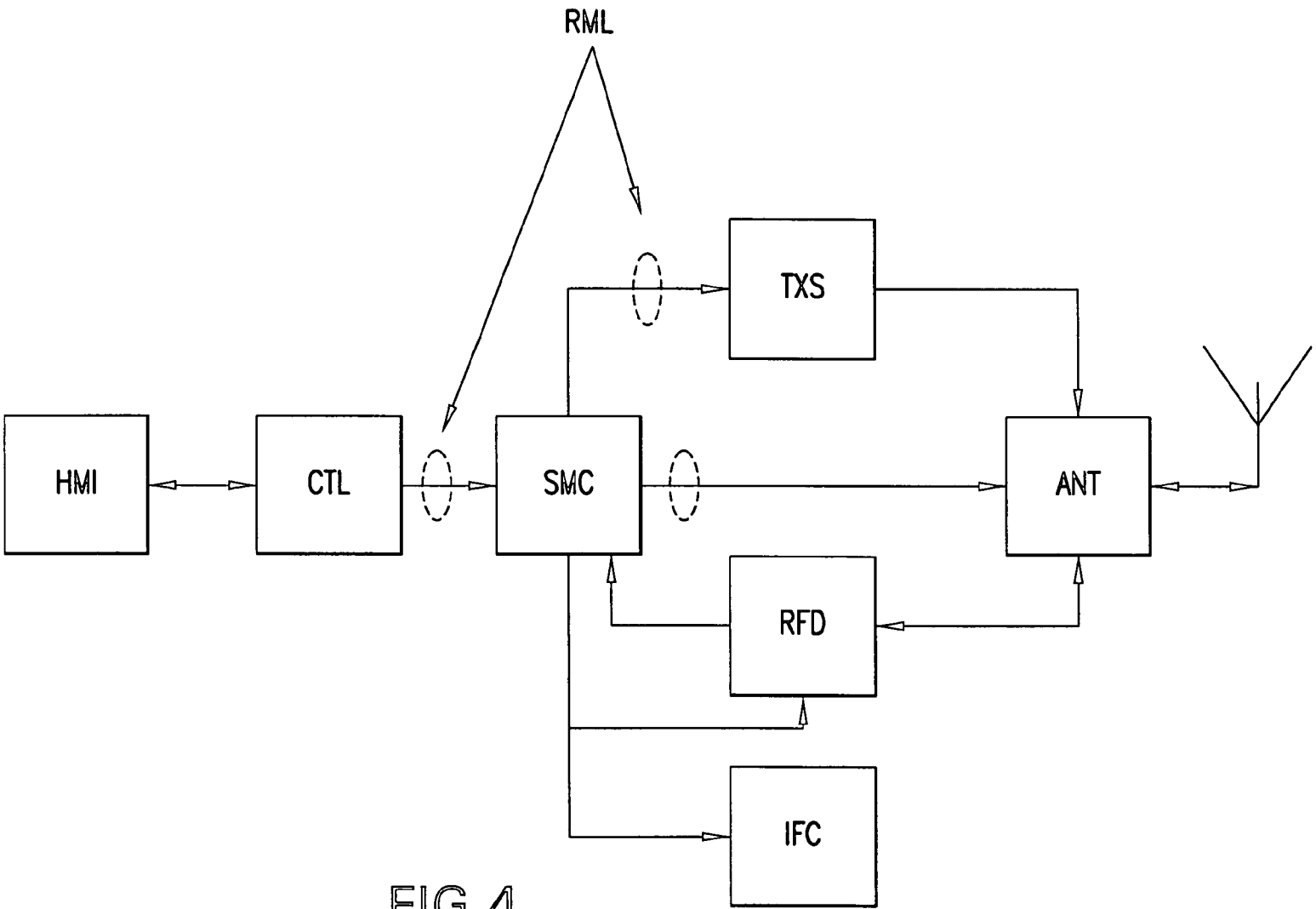
FIG. 4 is a block diagram of an obstacle avoidance radar system in accordance with one embodiment of this invention.

FIG. 4 shows a high level block diagram of the obstacle avoidance radar (OAR) system and how it interfaces with the antennas and human machine interface in accordance with one embodiment of this invention. The OAR itself comprises several modules as described herein below connected through a radar module link (RML) protocol operating over a low voltage differential signaling (LVDS) electrical interface.

1. Communication and Radar Controller (CTL): This module controls other radar modules to allow for the capture of radar profiles. Together with the radar sampler module it also performs pre-processing of the received data, including calibration and time stamping of the profiles. This module also implements the protocols to allow the OAR to communicate with the human machine interface. Functionality is also provided to allow the OAR to store data on a local flash disk.
2. Sampler and Controller (SMC): This module is responsible for controlling the radar transceiver and antenna and the sampling of the intermediate frequency (IF) signal. All devices are controlled through the RML interface. The module also interfaces with the positioning system as well as the power supply unit.
3. Transmit Synthesizer (TXS): The transmit synthesizer is responsible for generating the radar transmit waveform.
4. RFIF Demodulator (RFD): This module is responsible for demodulating the received RF signal down to the radar IF. It comprises a local oscillator synthesizer (LOS), RF downconvertor, IF stage and an IF cancellation module.
5. IF Cancellation Module (IFC): This module improves the dynamic range of the radar by removing the unwanted and large antenna reflections before conversion by the analog to digital converter (ADC).
6. Antenna Interface (ANT): This module is responsible for controlling the active antenna matching circuits. It also includes the circuitry to allow for full two port calibration of the radar electronics.

The radar module link (RML) is a high speed serial backplane technology that has been designed specifically for the radar. It provides both communications to all the radar modules, allowing them to be controlled through the SMC and CTL modules as well as a reference clock to all radar elements. All this is implemented using 2 low voltage differential signalling (LVDS) pairs, one bi-directional line and one clock line.

The antenna in accordance with one embodiment of this invention is connected by means of an antenna interface to the radar transceiver. This maps the two channel bistatic radar architecture to the required antenna interface and provides all the control circuitry to actively tune the antenna to the surrounding medium. This basically decouples the antenna design from the design of the radar system and simplifies the integration of new antenna technology with the radar. In addition the antenna interface includes RF circuitry to provide reference signals for the calibration of the radar system. This ensures a known phase center at the terminals of the antenna.

Figure 5:
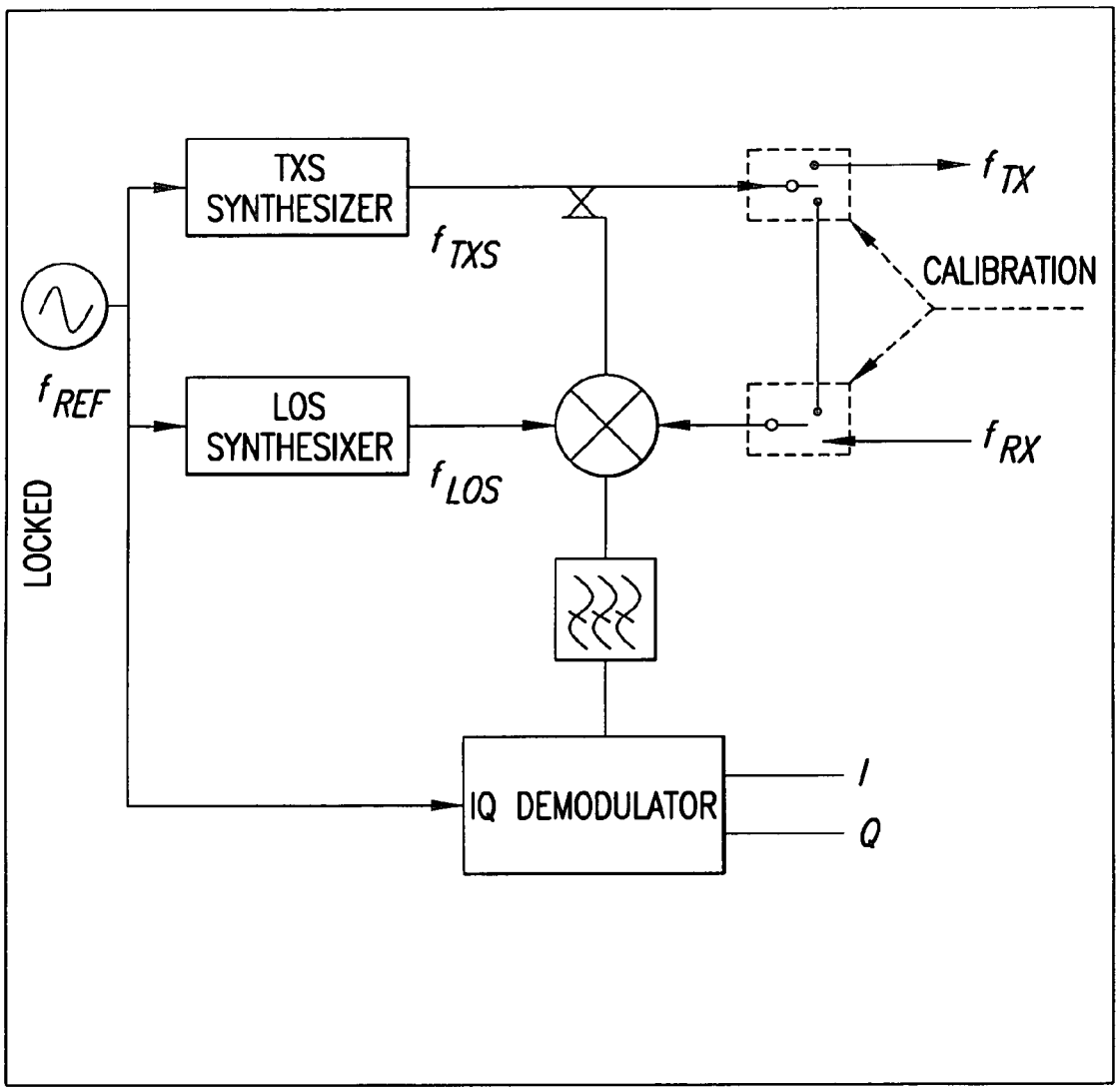
FIG. 5 is a diagram showing a dual synthesizer heterodyne architecture.

The TXS and RFD are responsible for the generation of the transmit signals and the conversion of the received signals into coherent intermediate frequency (IF). These modules together make up the radar transceiver. The radar transceiver is implemented using a frequency offset dual synthesizer heterodyne architecture as shown in FIG. 5. The system comprises separate transmit and receive synthesizers. Each synthesizer is locked to a common reference oscillator and offset from one another by the radar IF, $f_{JF}$. The transmit synthesizer is amplified and radiated through the antenna, after which it reflects off of an obstacle and is then received by the radar. This radio frequency (RF) signal is mixed with the receive synthesizer signal and then filtered at the IF. Since the IF can be designed to be far away (large frequency offset) from 0 Hz, the heterodyne architecture reduces the problem of temperature drift and alleviates the problem of flicker noise experienced by homodyne systems.

A further advantage provided by the heterodyne architecture is the requirement to filter the RF harmonics generated by the transmit and receive synthesizers. Consider the following transmit and receive synthesizer signals, namely $f_{TX}=nf_C$ and $f_{RX}=m(f_C+f_{IF})$, where $f_{TX}$ and $f_{RX}$ are the respective output frequencies of the two synthesizers. The frequencies at the output of the mixer are given by the equation below:

$$f_{IF}^{m}=\begin{cases} mf_C+mf_{IF}+nf_C \\ mf_c+mf_{if}-nf_C \end{cases}$$

Ignoring all frequencies greater than $f_C$, the frequency at the input to the IF filter is given by $f_{IF}^{M}=mf_{IF}$, where $f_{IF}$ is the IF resulting from the fundamental frequency of the synthesizer. Hence each harmonic of the IF corresponds to a harmonic of the transmit and the receive synthesizer. Practically, this radar architecture reduces filtering of the harmonics at the RF to a simpler problem of filtering the harmonics at the IF.

Both the transmitter and receiver use low cost digital phase lock loop (DPLL) synthesizers as found in the mobile communication industry. This allows for both a low cost and small size system. In addition, digital control systems are provided to optimize the PLL bandwidth and loop gain as a function of frequency— allowing for fast switching and good phase noise synthesizers. The synthesizers are designed to cover any two consecutive octaves of bandwidth from 50 MHz to 2 GHz.

The radar receiver includes an active frequency cancellation system which extends the radar instantaneous dynamic range by more than 30 dB. The module works by adding a known cancellation signal to the received IF channel and then adding the known signal back after digitization.

Figure 6:
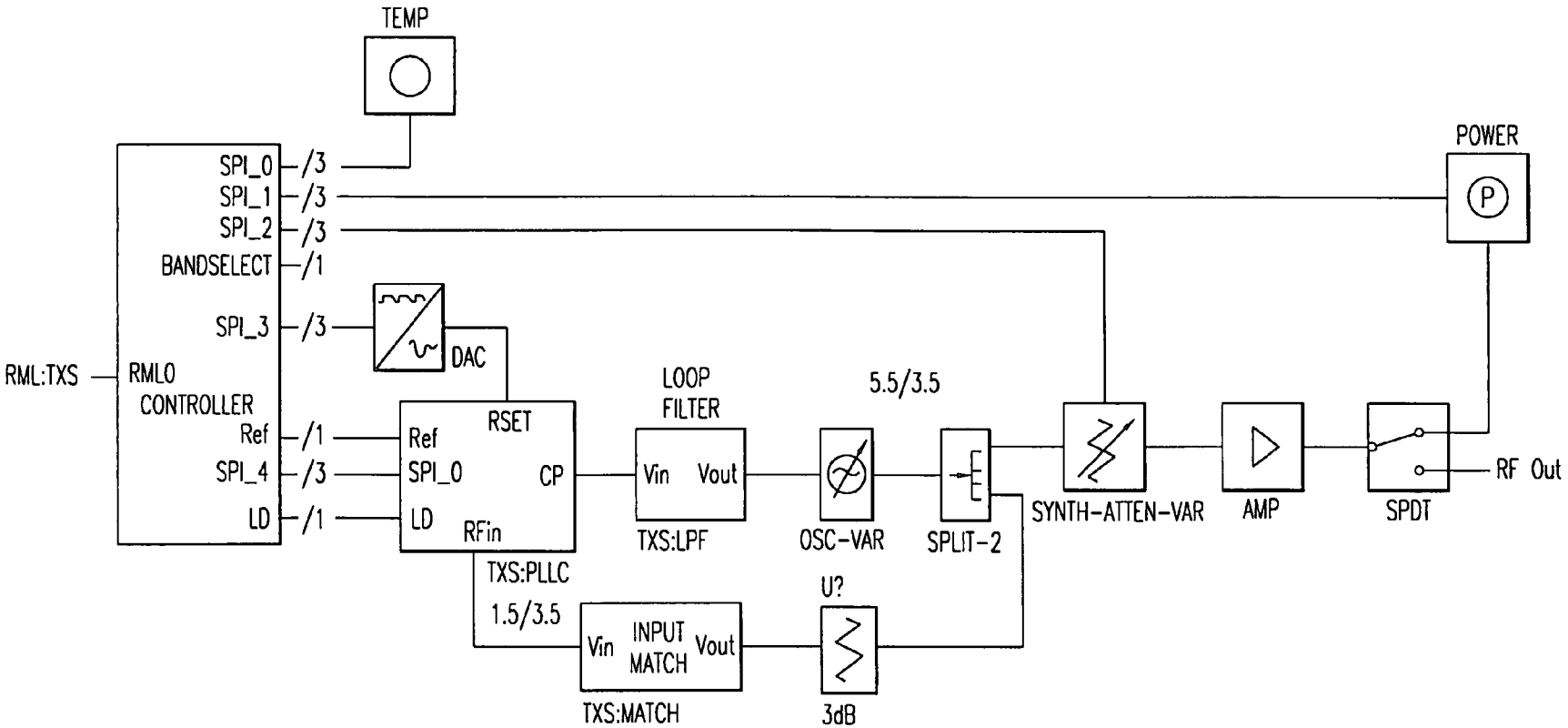
FIG. 6 is a block diagram of a transmit synthesizer module employed in an obstacle avoidance radar system in accordance with one embodiment of this invention.

FIG. 6 shows the block diagram of the TXS module. The system is based on low cost digital phase lock loop technology that uses loop gain control to extend the operation of the voltage controlled oscillator (VCO) to 1.5 octaves of bandwidth. The module also includes circuitry to monitor both the TXS output power and the temperature of the VCO. This allows for automatic leveling of the output power for changing temperature.

The TXS module is interfaced to the radar system by means of an FPGA that includes firmware to:

1. Implement the RML interface.
2. Provide a memory mapped interface to allow control of the various components that make up the TXS module.
3. Provide a table of frequency settings that provides a simple and fast low overhead communications control of the TXS module.

Figure 7:
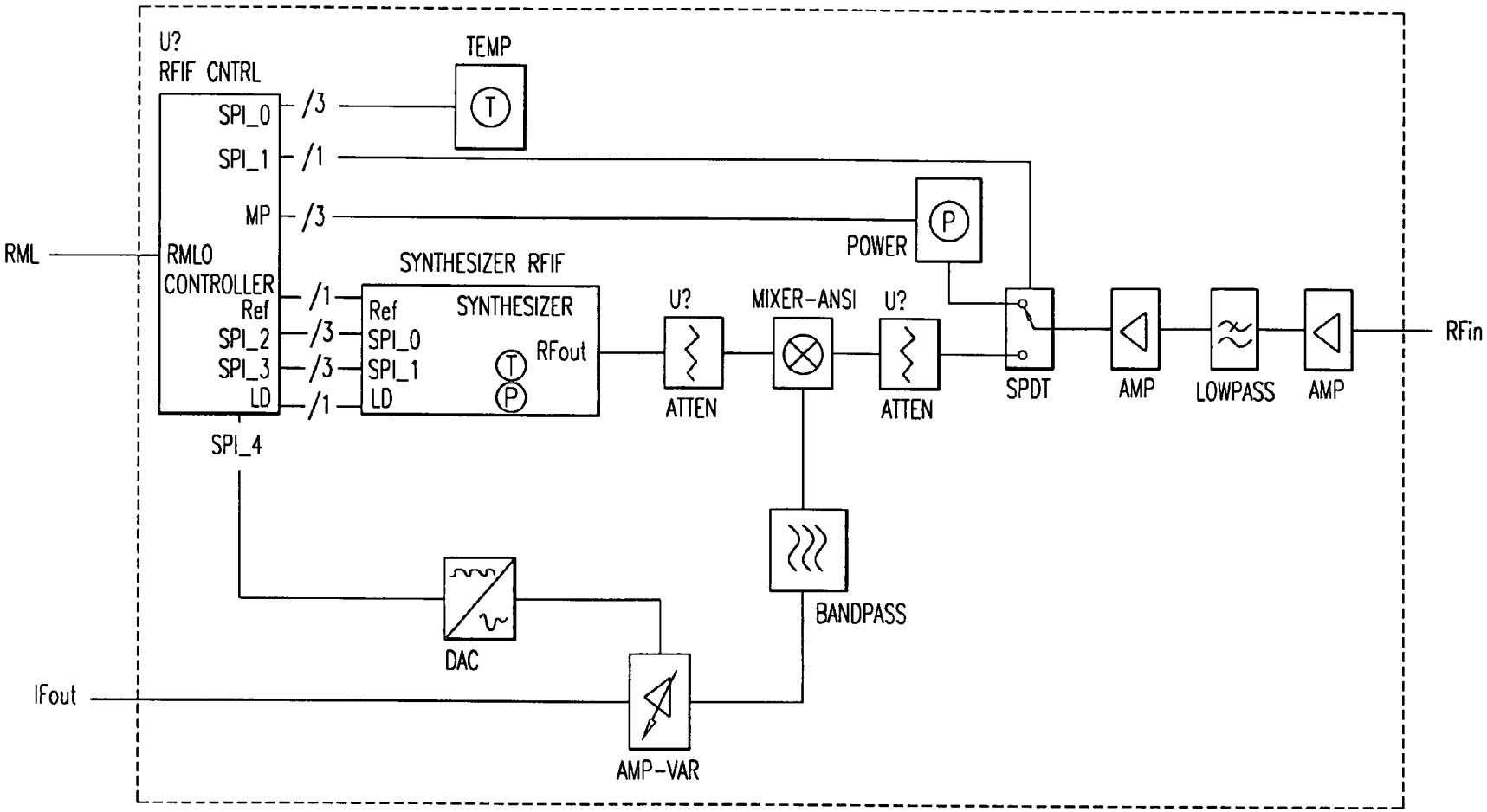
FIG. 7 is a block diagram of an RFIF demodulator module employed in an obstacle avoidance radar system in accordance with one embodiment of this invention.

FIG. 7 shows the block diagram of the RFD module. This module comprises the same synthesizer implementation as used in the TXS module. The received signal is amplified and then applied to a mixer which mixes the received signal with the local oscillator, to produce the IF frequency. This latter is then bandpass filtered, amplified and converted to a differential signal for transmission to the SMC module.

The module also makes provision to measure both the power of the received input signal (after filtering and amplification) and the transmit power of the local oscillator synthesizer. This allows in-situ calibration of the radar power levels. The module also includes a temperature sensor to measure the ambient temperature of the unit.

Figure 8:
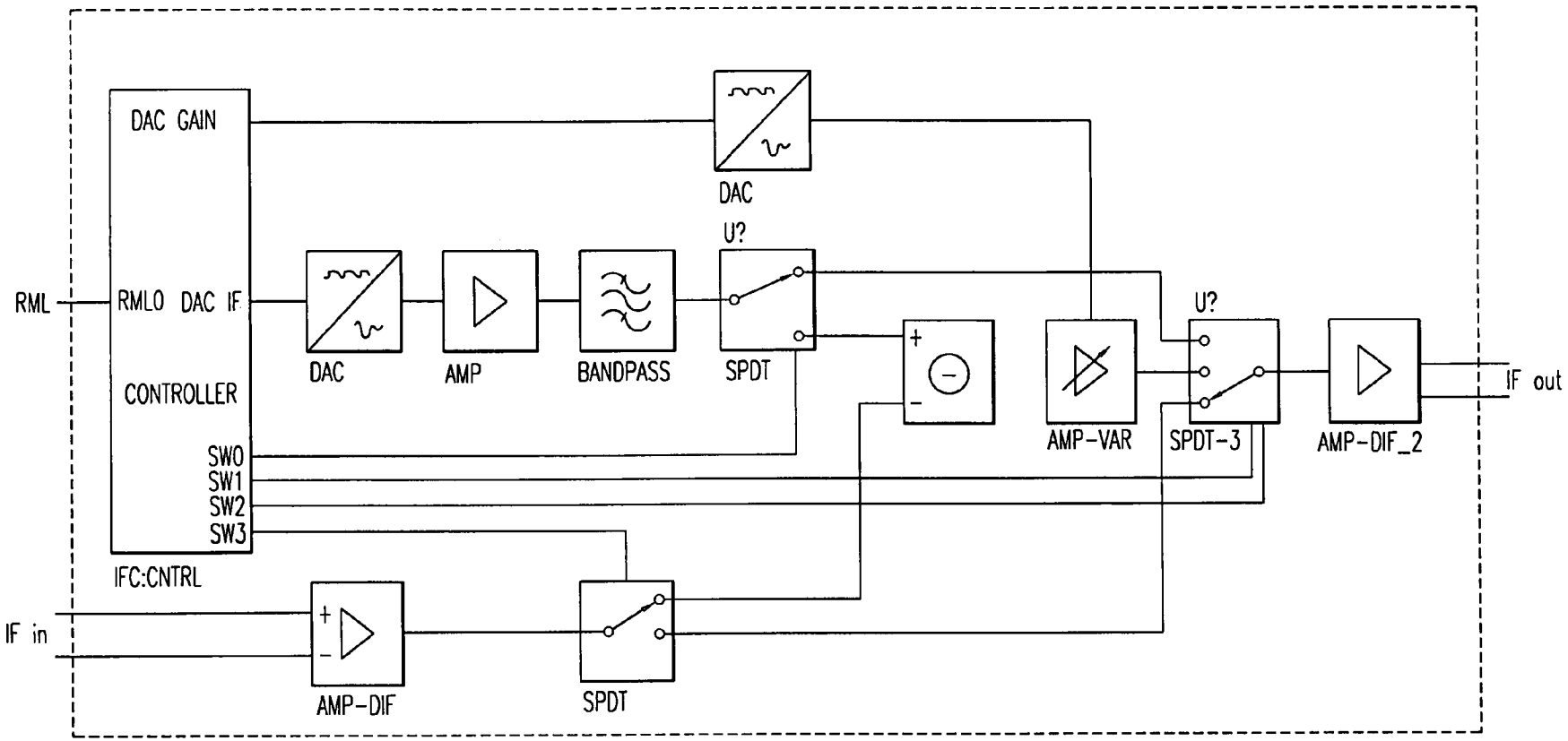
FIG. 8 is a block diagram of an IF cancellation module employed in an obstacle avoidance radar system in accordance with one embodiment of this invention.

FIG. 8 shows a block diagram of the IFC module. The IFC receives a differential IF signal from the RFD module. This signal can then be switched through to the output of the IFC module, or added to a cancellation signal. The cancellation signal is generated by the FPGA and then filtered to remove any digital noise. The algorithm to generate the cancellation signal allows for control of both the amplitude and the phase of the signal. The result of adding the cancellation and measured IF signal is then amplified and converted to a differential signal for transmission to the SMC module. The IFC provides control to allow measurement of both the raw received signal and the cancellation signal. This enables accurate calibration of the cancellation signal.

Figure 9:
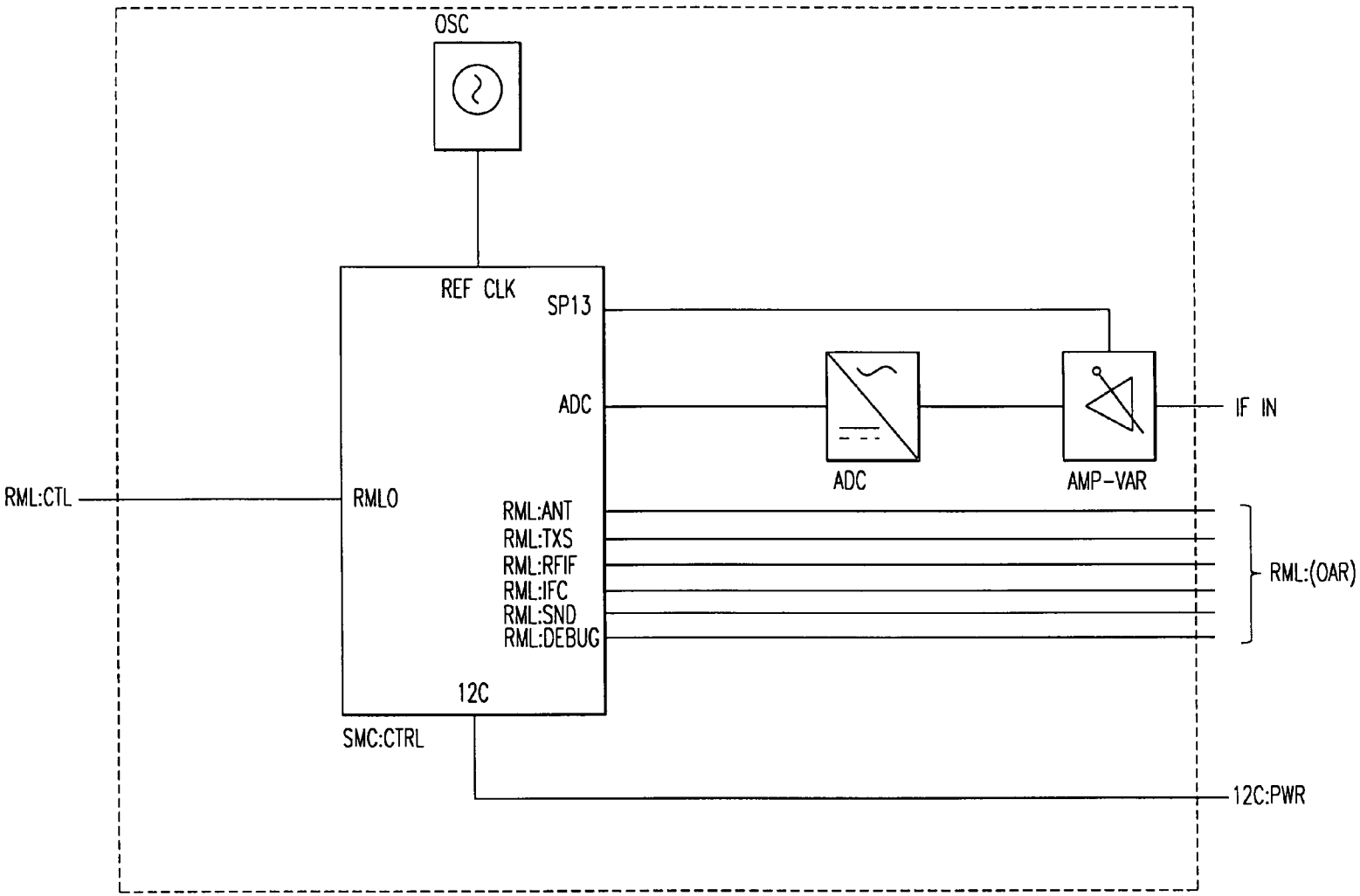
FIG. 9 is a block diagram of a sampler and control module employed in an obstacle avoidance radar system in accordance with one embodiment of this invention.

FIG. 9 shows a block diagram of the SMC module. This module is implemented using a FPGA (Field Programmable Gate Array) to perform high speed in phase and quaudrature (IQ) demodulation and a number of pre-processing signal conditioning functions. These include:

1. Signal averaging to improve signal-to-noise ratio.
2. Calibration for each frequency sample. Reference channels in the antenna interface unit are used in combination with calibration algorithms to remove frequency dispersion and improve transmit/receive isolation.
3. High speed complex FFT (Fast Fourier Transforms) with windowing.

The FPGA also controls the sampling process, all communications (RML) to the transceiver and antenna interface modules and synchronization relative to the master reference oscillator. This front-end processor improves the sweep time per range profile compared with earlier versions of this technology.

Figure 10:
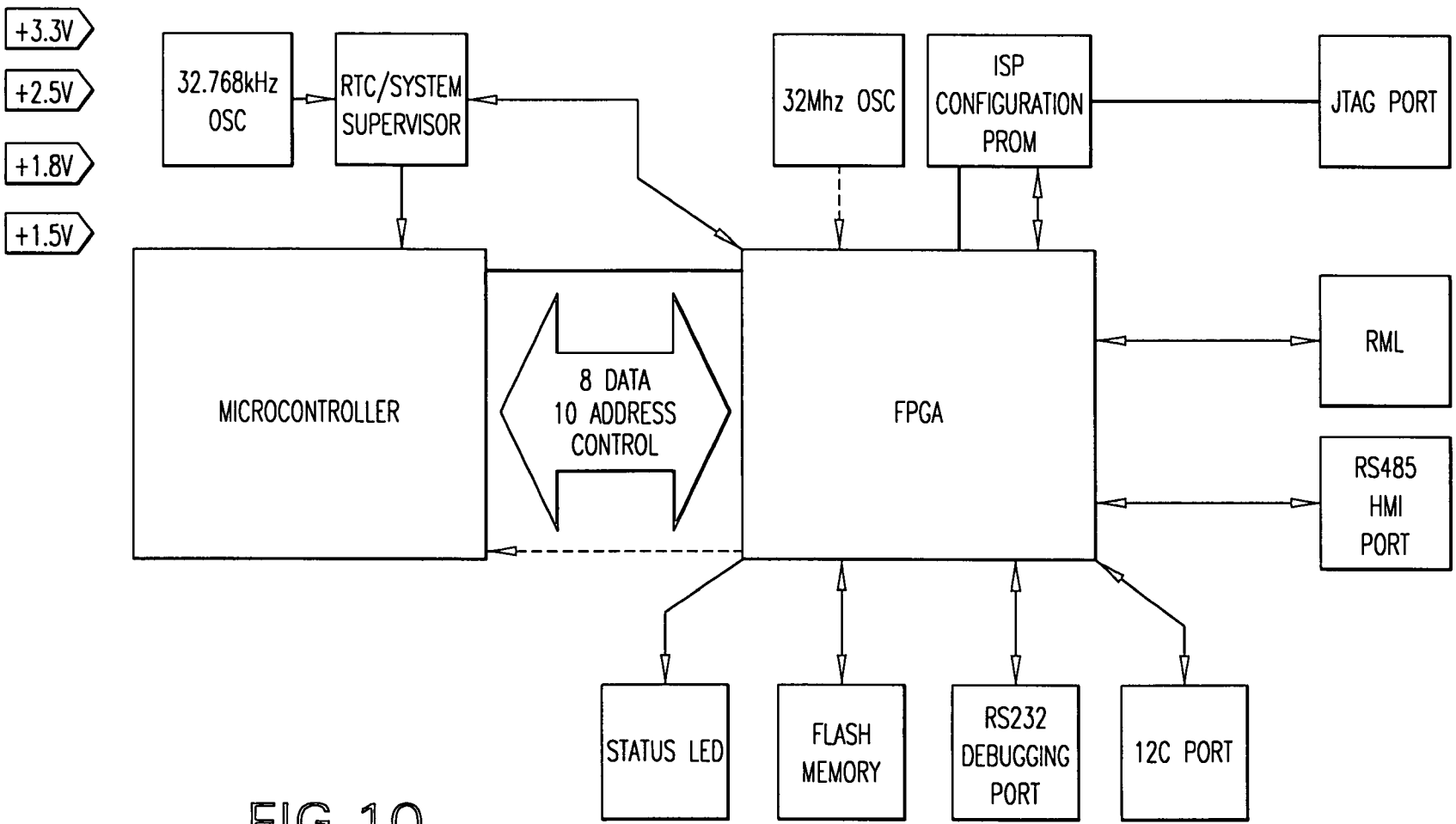
FIG. 10 is a block diagram of a radar controller employed in an obstacle avoidance radar system in accordance with one embodiment of this invention.

The radar controller and communication unit (CTL) is the main radar processor and controller. It controls all radar modules and provides various communication interfaces to the outside world. FIG. 10 shows the block diagram for the CTL. It comprises an ARM7TDMI microcontroller, FPGA to interface to the RML, real time clock (RTC), external flash storage and RS485 and RS422 communications. The RTC is used to time stamp all data captured by the radar transceiver. This time stamping is essential to synchronize data between various sensors and the radar. Solid state storage is provided to ensure that data can still be captured and stored when the communication links are down.

Embedded software on the CTL module provides the communications software interface between the HMI and the radar system. Communication is achieved using standard internet protocols. The software interfaces to the rest of the radar hardware through a memory mapped interface provided by the RML driver on the CTL FPGA. The CTL runs a small embedded operating system.

The HMI software is a framework allowing users to interact with multiple physical sensors connected in a network. The framework provides the following features:

i) Network connectivity to sensors
ii) GUI front-end tailored to specific users' requirements
iii) Distributed data acquisition
iv) Data persistence
v) Basic data processing.

Figure 11:
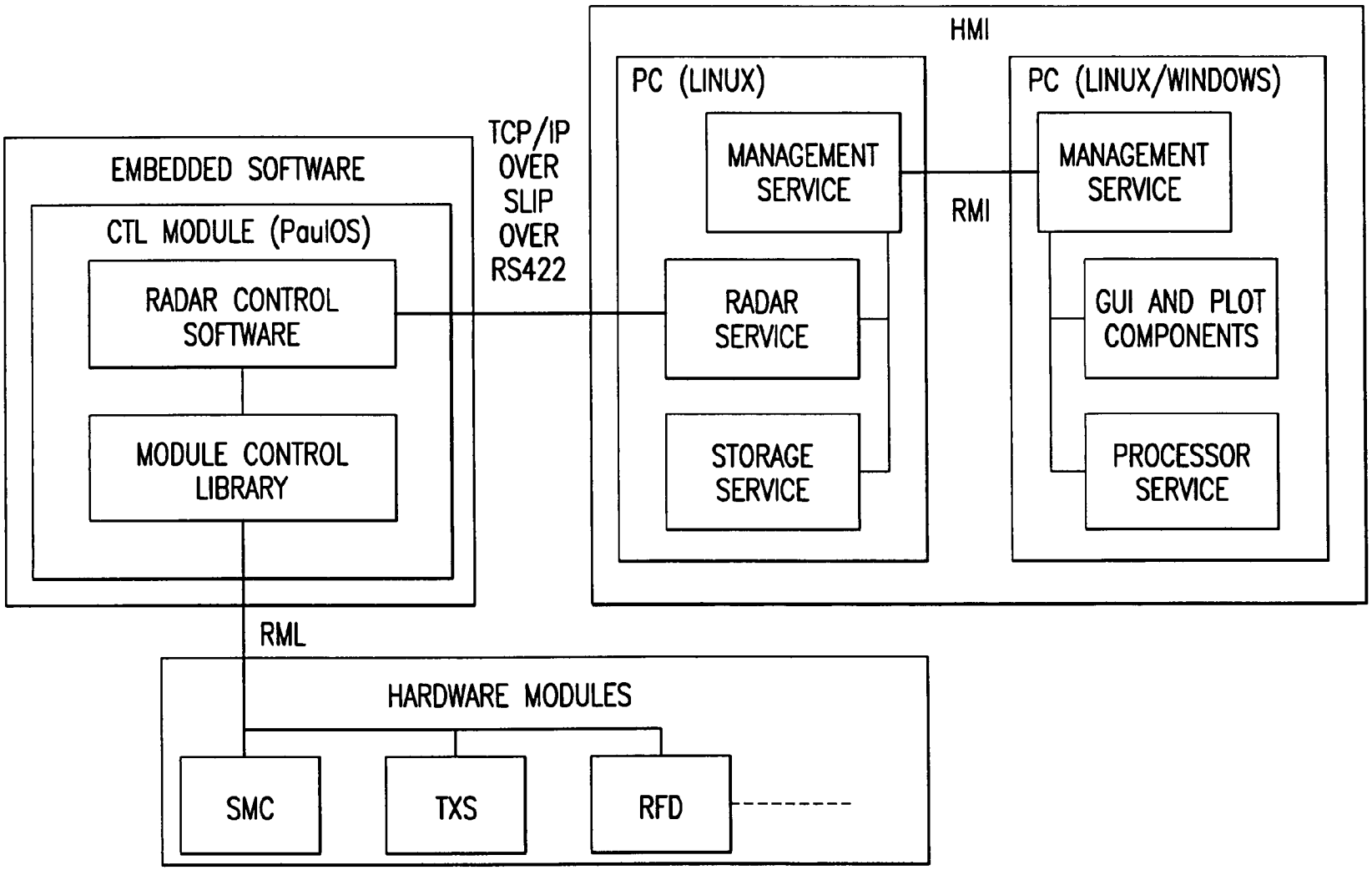
FIG. 11 is a block diagram of a software application employed in an obstacle avoidance radar system in accordance with one embodiment of this invention.
Figure 12:
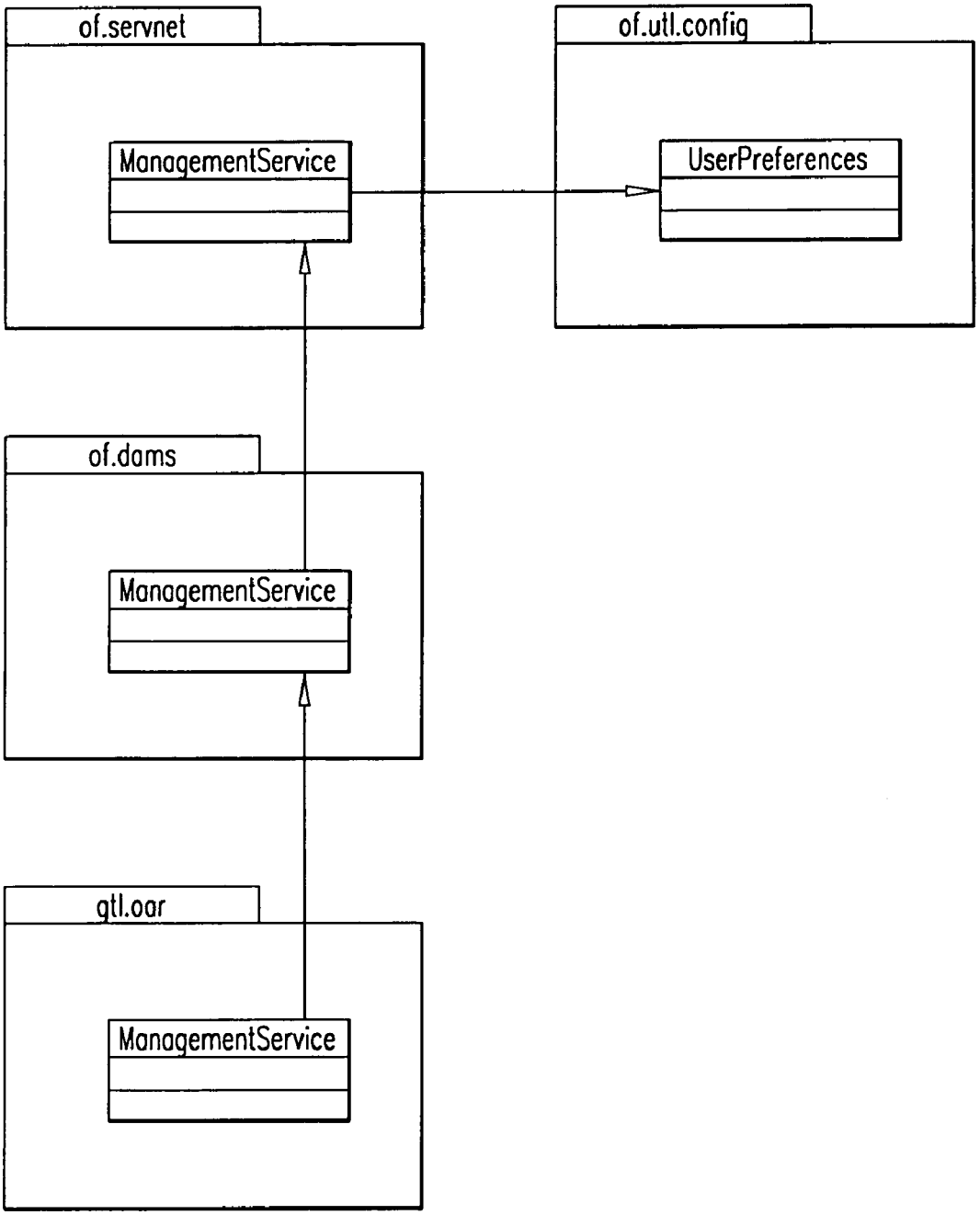
FIGS. 12–19 are UML diagrams for each major component of software suitable for use in this invention.
Figure 13:
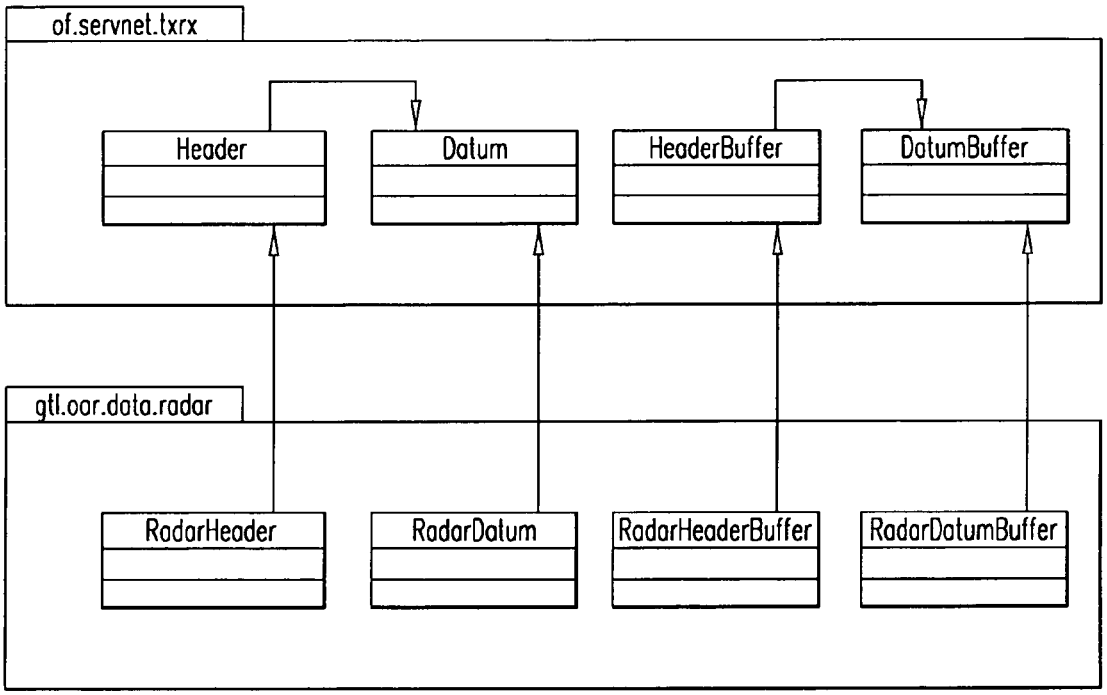
Figure 14:
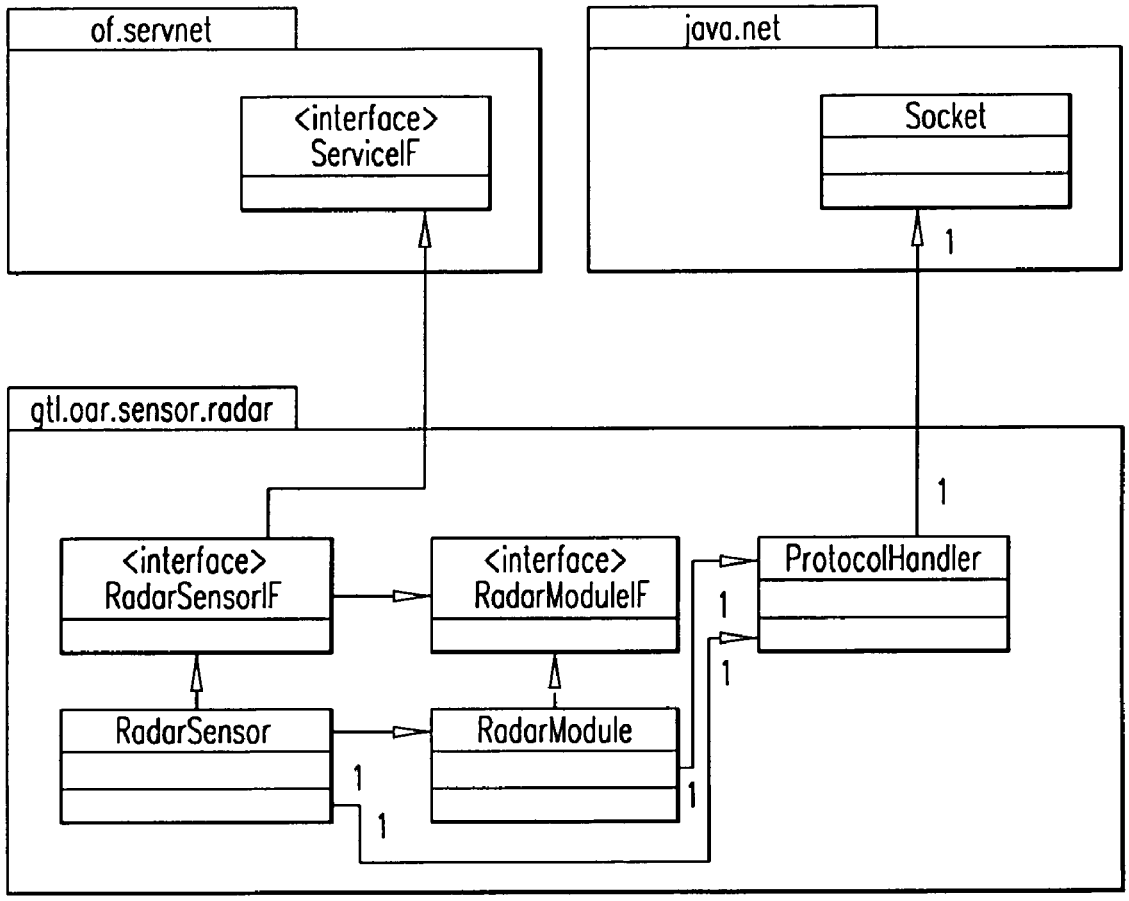
Figure 15:
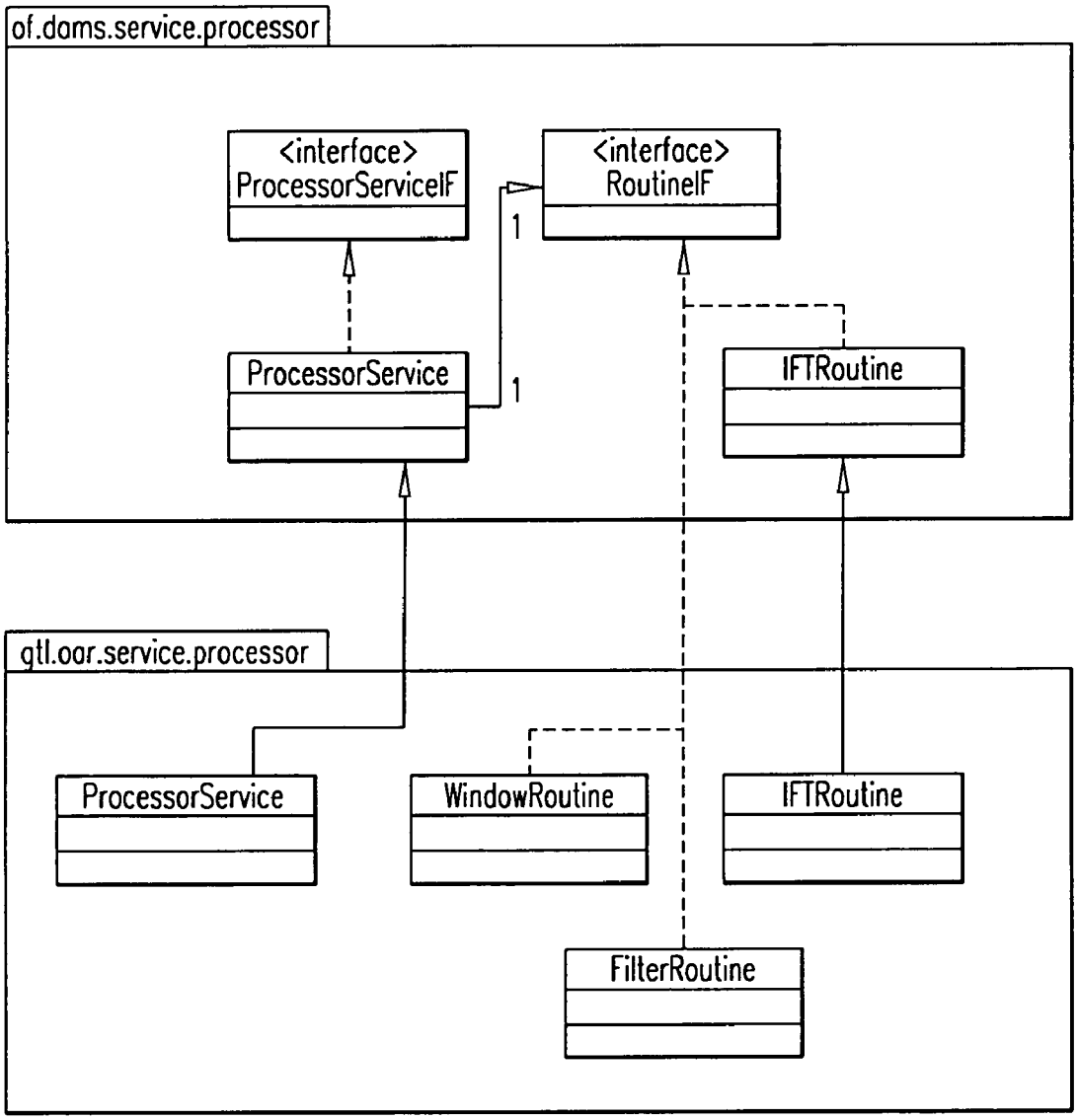
Figure 16:
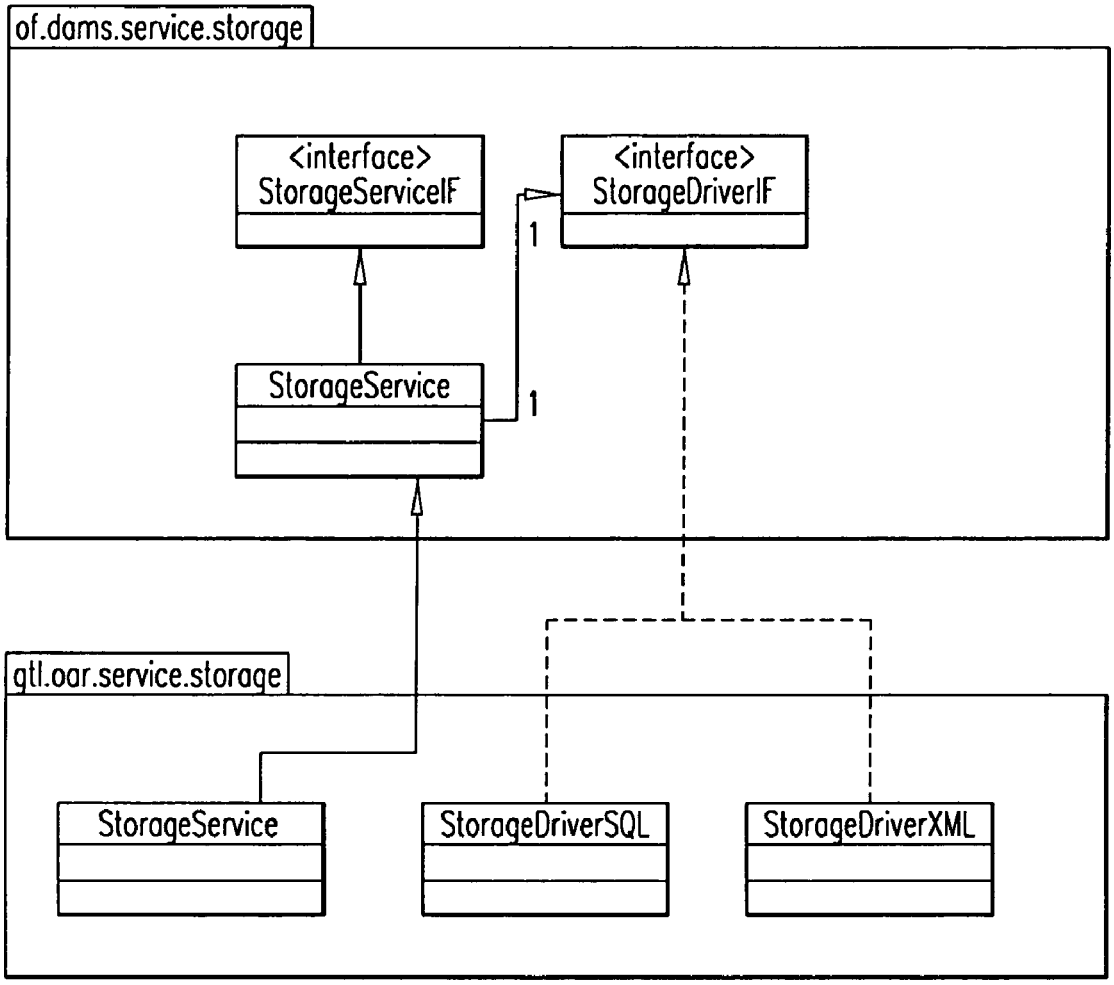
Figure 17:
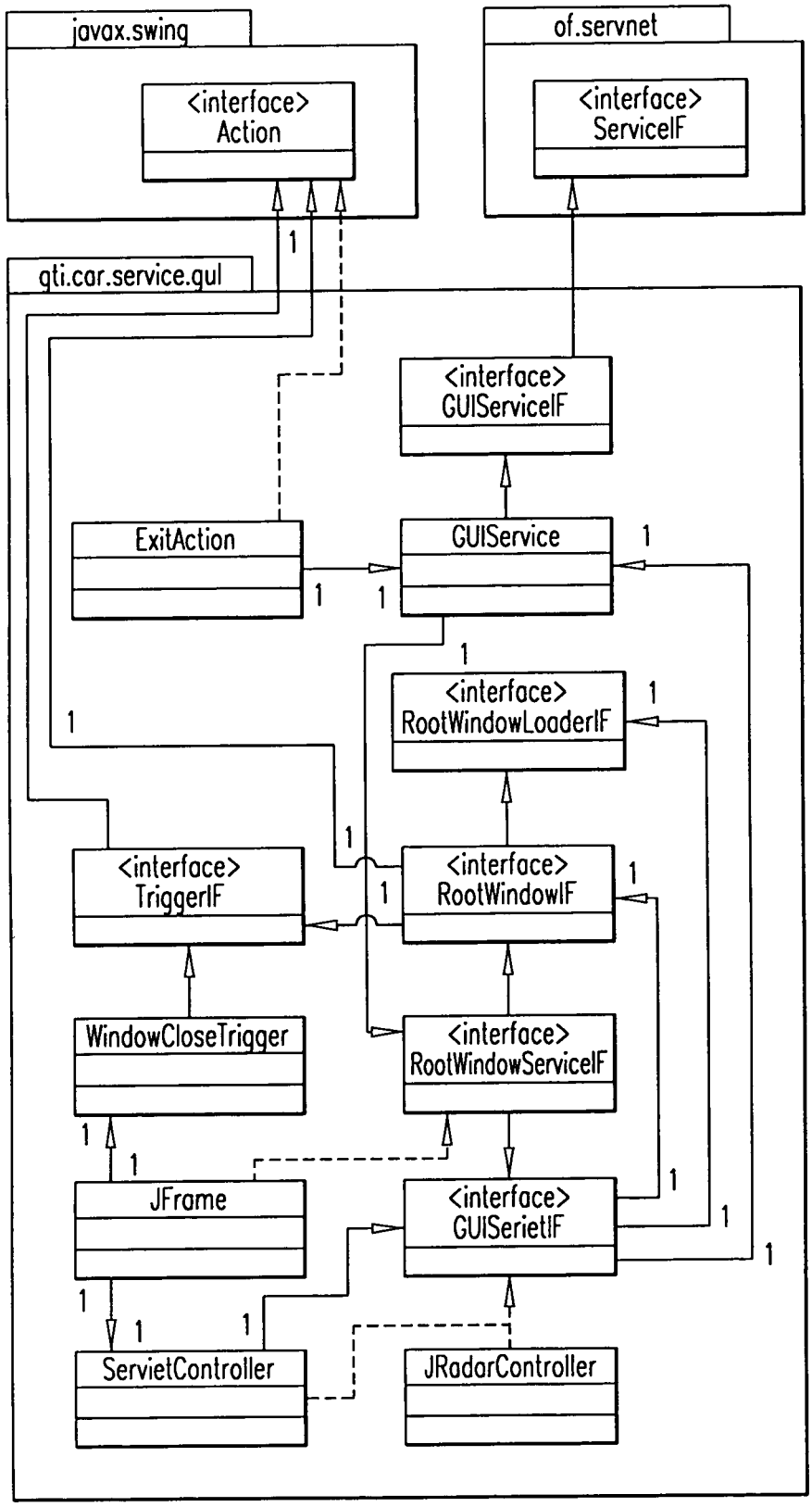
Figure 18:
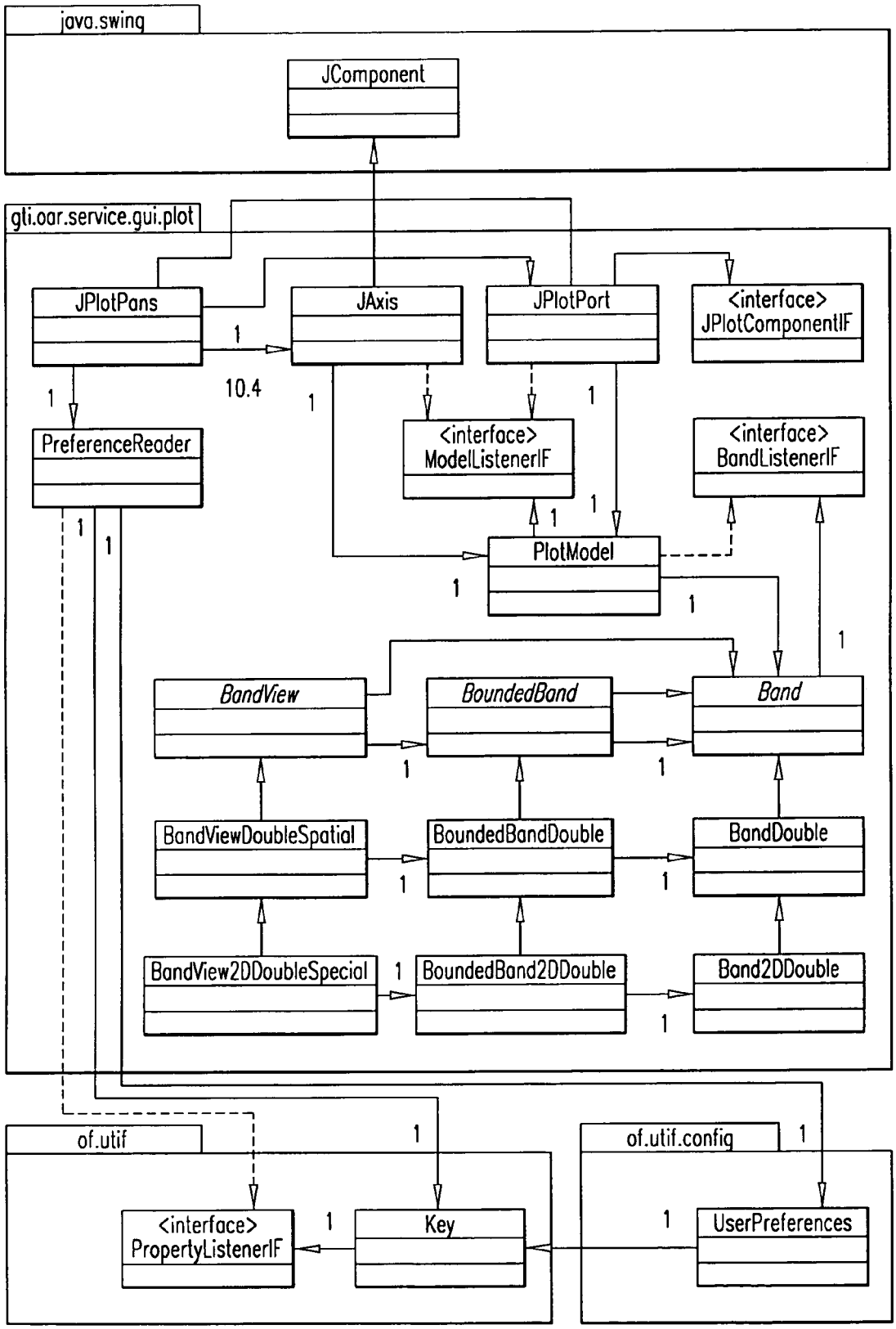
Figure 19:
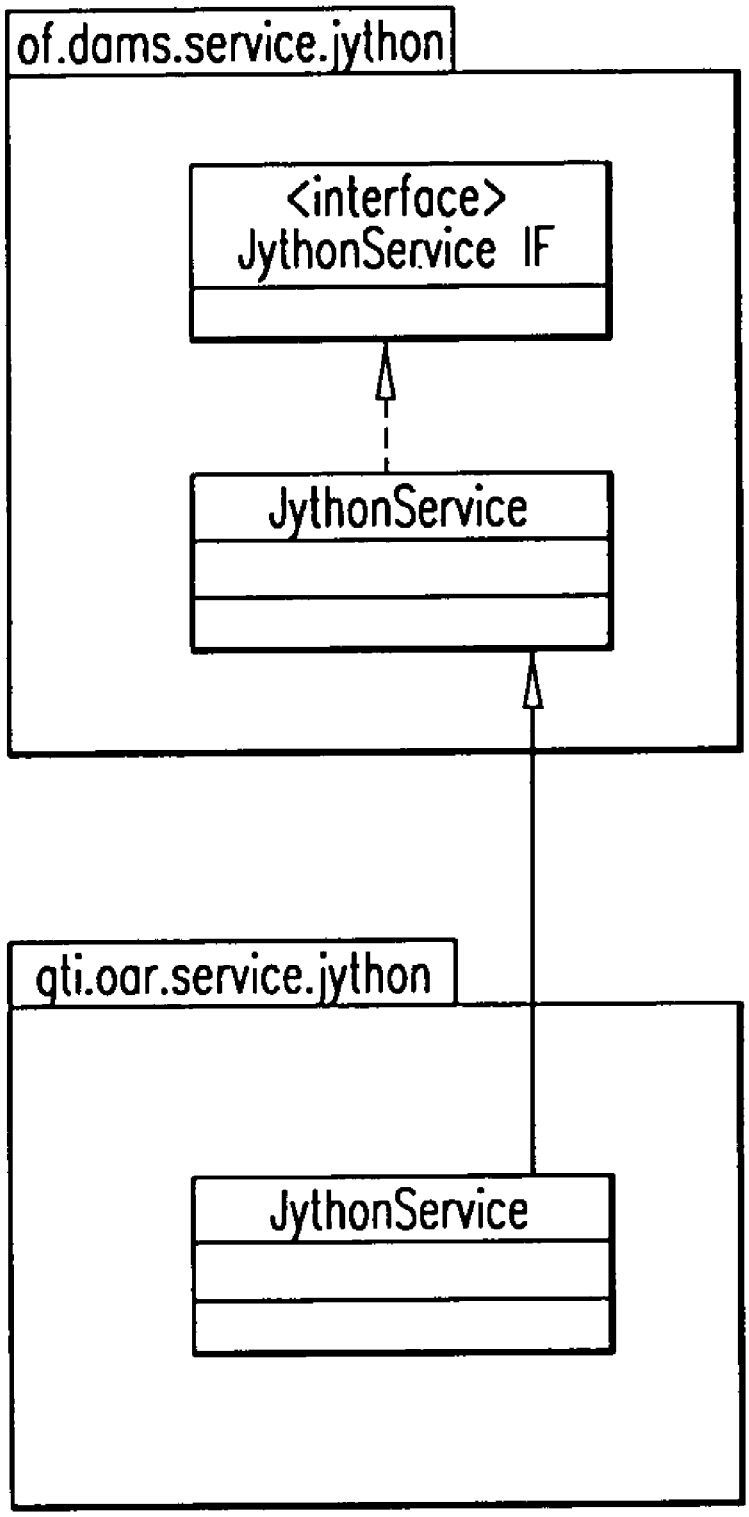

The software framework provides a collection of services that can be grouped together at run-time to perform a specific function for a particular user. FIG. 11 shows an example an HMI application interfacing to the radar hardware through embedded software running on the CTL module. This demonstrates the distributed nature of the HMI application, allowing one to separate interfaces to hardware from the processing and display. All data is persisted to the database for storage, including the system configuration. In this way, the complete state of the radar including software is maintained.

Each service provides a specific function; the following lists some of the services:

Sensor service: A service that provides a connection to a physical sensor. The service offers an interface through which the sensor can be controlled, and through which data can be acquired. Initially this service is connected to the radar.

Processor service: A configurable processing engine that accepts data from a service such as the sensor service, and provides the processed data to other services.

Storage service: A service that writes incoming data into a database. The data can later be extracted from the database and played back. The storage service can accept data from any source service such as a sensor service or processor service. The storage service stores the data as well as the configuration of the system at the time the data was stored. This allows the system to be reverted back to the exact view that was available at the time of capture.

GUI service: A component that offers a configurable GUI front-end to the application. The GUI service builds up a GUI based on a configuration file. The resulting GUI offers graphical control over the other services running in the application. Included in the GUI service is a data display component offering various views of the incoming data.

A set of services can be grouped together to form a desktop application, however each service can export a remote interface, allowing the application to be fully distributed on the network. This allows the physical sensor to be located on a site different from the rest of the application. While data is being acquired from the sensor, it can also be transmitted across the network to any interested users at the same time.

The above services are those that offer a specific use to the end-user. There are a couple of other services that are required to ensure that the application functions correctly. Specifically, there is a configuration service that manages the configuration information required by the system and a management service that manages the lifetimes of all the other services.

Several subsystems described herein below are required for proper operation of the obstacle detection sensor.

Communications Link

Data from the radar unit must be transmitted to the surface, and control signals communicated to the underground unit. This may be performed through a coaxial cable wireline, twisted wire pair, or perhaps through the drill rod itself. A preferred production unit may likely be battery powered, but may alternatively include provisions for sending power from the surface to the drill head.

Interface with Guidance Circuits

There currently exist sondes and other sensors that are routinely placed in the drill head that communicate drill head location, pitch, roll, and yaw. These data are useful to the interpretation of the drill head radar. Interfaces between these data and the radar display are preferably seamlessly integrated. Alternatively, a stand alone roll and pitch sensor may be integrated into the overall sensor design to provide information on the relative orientation of the sensing beam. Such an embodiment provides information on the direction of the main radar radiation lobe, and hence a relative position of obstacles relative to the drill head, but does not necessarily provide absolute position data with respect to the ground surface.

Tool Packaging

The radar units are preferably integrated (to the greatest extent possible) into existing drill designs. Thus, the sensors preferably fit in a small diameter head or rod, should not adversely affect drill performance, and should not result in a degradation of tool strength.

Software/Processing/Data Presentation

As important as the collection of high quality data is the manner in which those data are presented. First, data processing must be performed in real time. Sufficient time must be allowed for the operator to identify a potential utility in advance of the drill and have time to take corrective action. This requires any processing to be performed very quickly. It is possible that restrictions on drill advance rates may have to be imposed in areas where look-ahead radar is required. Second, data collected with a radar mounted on a rotating, advancing drill will potentially appear very different from that normally acquired from 'static' surface surveys. The trace of the imaged area will define a spiral around the drill rod. Thus, means to provide unwrapped signal information on the head rotation, horizontal position, and advance rate is integrated into the software. Information on the drill advance rate and orientation may also be used to produce an image of the bore that may be mated to obstacle detection. Processing and presentation software should be developed that presents these data in a simple clear-cut manner to the operator. Identification of reflecting targets should be rapid and as unambiguous as possible. Depending upon the rate of bore advance, an automatic analysis, warning, and shutdown system may be required or desired. This might also include an audible warning. Information from the sensors must be integrated with machine controls, preferably over a CAN type control bus, although other control communications systems may be used with equivalent functionality.

Advanced software is required to control the radar, process the acquired data and present a display to the operator in a manner that enables him to identify obstacles and make a decision to avoid them. The following discussion serves as a definitive description of the functioning of the HMI software. It concentrates on the manner of building the HMI software from existing components available from Open-Fuel (South Africa). UML diagrams are shown for each major component (FIGS. 12–19).

The design of the HMI software is based on of.servnet and of.dams frameworks. The former provides a platform for a configurable and distributed application, while the latter (built on top of of.servnet) provides more specific data acquisition functionality.

The of.servnet Framework

The servnet package is a service based framework from which a configurable, distributed application can be constructed. The servnet package allows a set of components (or services) written according to a set interface to be loaded and executed as an application. The servnet package provides an environment in which these services can exist and intercommunicate.

Servnet allows services to be distributed between machines. Servnet uses RMI to allow a service running on host A to transparently connect to a service running on host B and communicate directly with it. This means that applications built on top of the servnet platform can easily offer remote monitoring and configuration.

Servnet also provides a data transmission layer. The servnet.txrx package defines a set of interfaces and a base set of data structures that allows arbitrary data structures to be transmitted on multiple channels. The data transmission layer also works transparently over RMI, allowing data to be transmitted in a distributed environment. The data transmission layer decouples the service that produces data from the components that receive the data.

Servnet only provides the framework on top of which applications must be built. As such, servnet provides no useful functionality to the end user. The data structures defined by servnet contain no useful data in themselves, and the interfaces defined by servnet provide no useful functionality to the end user. An application that builds on top of servnet must define useful data structures, and useful interfaces specific to the application's purpose.

The of.dams Framework

The DAMS package (Data Acquisition for Multiple Sensors) is a framework built on top of the servnet framework. DAMS adds a set of service implementations to the servnet framework. The services that DAMS defines are used in a multisensor data acquisition application. DAMS adds the following services:

Storage Service

The Storage Service receives data from multiple channels and stores the data to some underlying storage medium (for example, database of XML file). The Storage Service is also able to retrieve previously stored data, and redistribute it to other services via the servnet distribution layer.

Processor Service

The Processor Service is a processing engine for data arriving on multiple channels. It receives data from the servnet distribution layer, processes the data, and retransmits the data on the servnet distribution layer.

Jython Service

The Jython Service provides an interactive scripting engine to the application. It uses the Jython interpreter to accomplish this. The Jython interpreter is a Java based interpreter for the Python scripting language. The Jython Service's main purpose is a debugging and testing aid.

Sensor Services

DAMS has a couple of sensor services defined that acquire data from different services. In order to allow multiple sensors to be integrated into a single data set, DAMS provides the Sensor Intergrator. The sensor integrator centralizes basic control over a set of separate sensor services. The sensor integrator reads data from all of the sensor services under its control, integrating the data into a multichannel data stream.

The of.util Package

This package contains generic utilities that are used by both the of servnet and of.dams frameworks, and therefore are used by the HMI software.

Management Service

The ManagementService is responsible for bringing up the application at startup. The of servnet ManagementService reads the configuration from XML file or database, and fires up the appropriate services. It is also responsible for locating the key that contains the user preferences for the application, and ensuring that the UserPreferences class correctly references this key.

The of.dams ManagementService provides the main function from which the application is started; however it delegates the actual startup to the of.servnet ManagementService.

Radar Service

Data is transmitted through the of.servnet framework as a series of packet-like structures. A data transmission session consists of data being transmitted on any number of channels. A header is transmitted on each channel before the actual data packets are transmitted.

The header contains information that is applicable to all data packets on that channel. For example, the radar data header will contain the configuration information for the radar hardware itself (such as frequency range).

These packets have been conceptualized into the Header and Datum classes. The Header and Datum classes are immutable—once a Datum or Header instance has been created, it cannot be modified. This allows data to be shared across different threads without compromising their validity. In order to facilitate their construction, the HeaderBuffer and DatumBuffer classes have been defined. These classes contain the same information that the Datum and Header classes contain; however they are not immutable. The main purpose of the buffer classes is to reduce the creation of Datum instances during data processing. When the Processor Service receives a Datum instance, it is converted to a DatumBuffer instance which is then handed off for processing. The DatumBuffer instance allows processing to occur "in place" where appropriate. After the processing is completed, the DatumBuffer instance is then used to create the final processed Datum instance.

The Header and Datum classes must be subclassed in order for useful data to be transmitted. The GPRHeader and GPRDatum classes are defined in the gti.oar.data.gpr package. These classes wrap the radar data that will be transmitted and stored in the application. Similarly, the GPRDatumBuffer and GPRHeader classes are defined.

The data classes are defined in their own data package since these data classes will need to be used from many different classes in the application. The processing routines defined for the Processor Service will accept only certain types of data, while the data displays will also only accept certain types of data.

Radar Sensor

The RadarSensor is responsible for connecting to the radar hardware, controlling the hardware and acquiring data from the hardware and making it available to the rest of the application. The RadarSensorIF interface defines the interface through which the application is able to interact with the RadarSensor. The RadarModuleIF interface defines generic methods for getting and setting the configuration for a specific module. Since the radar as a whole is viewed also as a module which can be configured, the RadarSensorIF extends the RadarModuleIF interface. The RadarSensorIF interface adds methods for controlling the data acquisition process, as well as for determining which other hardware modules are present and can be configured.

The RadarSensor class provides the implementation for the RadarSensorIF interface. It communicates with the hardware via TCP/IP, using the standard java.net.Socket class. The actual protocol is a text based protocol that is handled by the ProtocolHandler class. The ProtocolHandler class is responsible for implementing the string-based protocol over TCP/IP that is discussed in the IDD and the embedded software design.

The RadarSensor class acquires data from the radar hardware, and uses the of.servnet.txrx package for distributing the data within the application.

Processor Service

The of.dams.service Processor Service is a multichannel processing engine. The processor service itself delegates the actual processing work to a set of routines. Each routine describes a set processing unit. The output of one routine forms the input to the next routine. The processor service links a set of routines together to form a chain that accomplishes the desired processing.

Storage Service

The storage service is responsible for persisting the data to some underlying medium such as a database or file. The storage service persists both the data as well as the entire configuration for the application at the time the data was persisted. This is important since it allows the state of the application to be restored in order to view the data at some later date as it would have appeared when it was stored.

The of.dams StorageService accepts multiple channels and writes the data via the StorageDriverIF interface to the underlying medium. The StorageDriverIF interface defines an interface through which the data as well as the system configuration can be stored. The StorageDriverIF interface also defines methods for retrieving previously stored data.

The configuration for the of.dams StorageService defines the underlying type of the StorageDriverIF to be instantiated and used. This makes it possible to easily switch the destination to which data is stored.

GUI Service

The GUI component of the application software is written as another ServiceIF implementation. Any class that is involved in the GUI of the application is therefore packaged into the gti.oar.service.gui package.

When the GUIService itself is loaded and started via the ServiceCoreIF, it loads and starts the actual GUI frames that appear on the screen. The RootWindowServletIF interface was defined for this purpose.

The RootWindowServletIF abstracts the actual type of the frame used. The GUIService can have any number of root windows, whether they are implemented asjavax.swing.JFrame subclasses,java.awt.Window subclasses or some other type of frame is irelevent.

The RootWindowServletIF interface extends two interfaces, the RootWindowIF and the GUIServletIF. The GUIServletIF interface defines the methods used to load, start and stop any GUI element. This interface loosely resembles the ServiceCoreIF. The GUIServletIF defines a two stage startup process GUI elements that matches the two stage startup process of the application and its services.

During the GUIService's load cycle, it calls load on all GUIServlets that it creates. During this cycle, the GUI components set themselves up, configuring themselves from the configuration information supplied to them via the load method. Each element at this stage is isolated from any other element and service, so that there are no restrictions on the order in which elements can be created.

During the GUIService's start cycle, it calls start on all the GUIServlets that have been loaded. It is during this cycle that GUIComponents are able to find and link to other GUI components and other services. For example, a radar controller GUI element needs to attach to the radar service. During the start cycle, the GUI controller uses the ManagementService to find the radar service.

The RootWindowIF interface defines methods through which a GUI component can add menu items, toolbar buttons etc to the root window. During the start cycle of the GUIService, GUI components are given a RootWindowIF reference via the start method.

The RootWindowLoaderIF was defined to separate definition methods from lookup methods. A RootWindowLoaderIF reference is passed to GUI components during their load cycle. The following scenario clarifies the purpose of these interfaces:

1. The GUIService is instantiated by the ManagementService, and the ManagementService invokes GUIService.load (Key) on the GUIService.
2. The GUIService extracts its configuration from the key, which includes the type of the RootWindowServletIF to be constructed (assume this is a JFrame). The GUIService instantiates the new JFrame, and calls load on the JFrame (defined by GUIServletIF.load). The JFrame implements the RootWindowLoaderIF and RootWindowIF interfaces implicitly via the RootWindowServletIF interface.
3. The JFrame reads its configuration, and determines which GUI components to instantiate. Each GUI component implements the GUIServletIF interface, and the JFrame calls the GUIServletIF.load method on each of them, passing itself as a RootWindowLoaderIF reference to each GUI component.
4. Each GUI component reads its configuration and configures itself accordingly (which may involve loading further GUIServletIF instances). The RootWindowLoaderIF reference is used to share aspects with other components. For example, a GUI component may have some action that it performs that other gui components should be able to use. The RootWindowLoaderIF.defineAction method is used to share this action. The JFrame maintains a hashtable of actions linked by name and stores the shared action in this list. The RootWindowLoaderIF only allows actions to be defined, but not fetched. This prevents GUI components from trying to access an action that has not been defined yet due to some other GUI component not yet being loaded.
5. Once load has been called on all components, the GUIService's load method returns, and the ManagementService calls start on the GUIService.
6. The GuIService calls start on all its root windows—in this case, only the JFrame.
7. The JFrame calls start on all its GUI components, passing itself as a RootWindowIF reference into the start method.
8. Each GUI component can now use the RootWindowIF.getAction method to access the actions previously defined during the load cycle. The start method also carries the GUIService reference to each GUI component. This allows GUI components to interact with their host GUIService. Specifically, this allows GUI components access to the ManagementServiceIF interface, allowing GUI components to lookup other services (for example, the GUI radar controller to look up the RadarService that it must control).
9. When the application is shut down, the GUIService.stop method is called, which in turn propagates to all GUI components. This allows GUI components to perform any cleaning up.

Actions and Triggers

Java uses the Action interface to encapsulate information regarding an action that occurs in response to an event such as a button press. An Action can only be linked to elements that use ActionListeners to communicate events (such as JButton and JmenuItem).

The TriggerIF interface makes it possible to link Action instances to anything that can result in some event occurring. For example, the action of shutting down the application can be encapsulated in a CloseAction class that implements the javax.swing.Action interface.

This ExitAction can then be defined using the RootWindowLoaderIF.defineAction method. The ExitAction shuts down the application when triggered.

A WindowClose trigger can then be defined which is triggered when the user closes the Jframe. This WindowClose trigger then gets linked to the ExitAction via the TriggerIF.setAction call, so that when the user closes the JFrame, the ExitAction is called, thereby shutting down the application. The ExitAction is shared however, so toolbar buttons can also be added that also link to the ExitAction.

Servlet Container

The ServletContainer is a utility class for container classes that load other GUIServletIF instances. This is convenient since both JFrame and JPanel containers must load and start a set of child GUIServletIF instances. The ServletContainer class encapsulates the code that instantiates and iterates through the children calling the appropriate load and start methods on each child. The ServletContainer itself implements the GUIServletIF interface, simply clarifying the load/start/stop cycle—the implementation of the ServletContainer's load method will be to instantiate and load all children.

GUI Plot Component

The purpose of the plotting framework is to provide a highly flexible framework which can be used to create a variety of plots to be used in other graphical components (such as the GUI radar controller).

The JPlotPane class provides the base JComponent in which a plot can exist on screen. The JPlotPane class is similar to the javax.swing.JScrollPane class, in that it is merely a view onto another component.

The JPlotPane can have up to four JAxis components added. The JAxis class is a JComponent that displays a legend of some form. Currently there are two possibilities:

1. Spatial axis: A standard axis that shows ticks as a ruler shows distance.
2. Colour axis: A legend type axis that shows a colour spread indicating the value associated with a particular colour.

Any number of JPlotPort instances can be added to a single JplotPane. A JPlotPort is a JComponent subclass that provides a canvas on which other plot elements can draw. The JPlotPort uses instances of the JPlotComonentIF interface to do the work of drawing the different plots. There is typically a JPlotComponentIF implementation class for each different type of plot. The following types have been identified:

1. JLinePlot—A plot component that draws a standard XY plot of some data.
2. JColorPlot—A plot component that draws a pseudo colour plot of some 3 dimensional data.

The actual data from which the plots are drawn is stored in a PlotModel class. A single PlotModel instance will store all the data for a set of plot components for a single JplotPort. The PlotModel class uses the concept of a Band to store the raw data. A PlotModel instance can reference any number of Bands.

A Band holds the data for a single dimension. Hence, for an XY plot where y=f(x), there will be two Bands, one holding the independent variable data (x) and the other holding the dependent variable data (y).

The Band class is abstract, with specific Band subclasses defining the actual type of the data being plotted. For the above example, the two Band types would be BandDouble (for x) and BandDoubleArray (for y).

The BandDouble class assumes that it represents a set of n samples from a minimum to a maximum value, with a constant step size of (min–max)/n.

The BandDoubleArray class holds the dependent values corresponding to samples represented by the BandDouble class. The BandDoubleArray class's' min and max values are then determined by the minimum and maximum values of the data set.

This separation of a data set into Bands allows different plotting elements to share the data model from which the raw data is extracted. The JAxis representing the y axis only needs to reference the BandDoubleArray band (which it does through the BandDouble superclass), while the JAxis representing the x axis references the BandDouble instance. The JLinePlot component will need to reference both bands.

The Band concept is extended with the idea of a BoundedBand. The BoundedBand represents a band with a particular view associated with it. The BoundedBand class references a Band class, from where the actual data is obtained, however the BoundedBand class adds the additional minimum and maximum bounds that determine the range of data that is actually visible in the plot. The BoundedBand class offers the same API as the Band class, but adds the ability to access the bounds.

Finally, a third band layer is added—the BandView class. The BandView class references a BoundedBand, but adds the mapping from actual data values to their on screen equivalent. Two types of BandView classes have been identified:

1. BandViewSpatial—Data is represented on screen as spatial distance (for example, the XY plot)
2. BandViewColour—Data is represented on screen as a colour (for example, the pseudo colour plot).

The actual type of the two bands that the JLinePlot therefore references is BandViewDoubleSpatial. Similarly, the two JAxis instances will also reference the BandViewDoubleSpatial bands.

The above discussion was focused on the simple case of 2 dimensional data being drawn as an XY plot. The figure shows the case where there is 3 dimensional data. In this case, the band in which the actual sampled data occurs must provide access to a 2 dimensional array. The Band2DDouble class is defined for this purpose. Similarly, the BoundedBand2DDouble provides access to the data held in the Band2DDouble class, while also holding the viewing bounds for the band.

Data is added to the plot by adding the data to the appropriate bands at the level of the BandDouble. In the case of 3 dimensional data, the process of adding data will normally involve adding data to the Band2DDouble instance, as well as modifying data in 1 or both of the other bands.

In order to avoid intermediate updates from occurring while data is being added to the data model, the updates are queued within the PlotModel class in the manner described in the following paragraphs.

A Band can have any number of BandListenerIF implementations registered with it. When data is added to a specific band, it calls bandChanged on all its listeners. The PlotModel to which all Band instances are added registers itself as a BandlistenerIF with every band. When data is added to a specific band, the PlotModel is therefore notified immediately.

The PlotModel allows ModelListenerIF instances to register for ModelEvents. ModelEvents are fired to indicate that a change has occurred to the data model in an underlying band. The PlotModel does not fire off a new ModelEvent for every bandChanged notification that it receives from the underlying bands. Instead it stores those bandChanged notifications in a ModelEvent that it slowly builds up. Only when the PlotModel.commitChanges method is called does the PlotModel fire off the current ModelEvent to ModelListenerIFs. This allows data to be added to a collection of bands before the notification is sent to other plot components. The net effect is to reduce the number of screen updates that would otherwise occur.

Finally, a PreferenceReader is used to provide a convenient means of accessing preferences from the global UserPreferences for the application. Such preferences will include the Dimension to Unit mappings that allow the user to specify whether length should be measured in feet or meters. The PreferenceReader uses the PropertyListenerIF interface to remain up to date with the global preferences stored in the Key referenced by the global preferences.

Jython Service

The of.dams JythonService is an interactive jython interpreter. Jython is a Java implementation of the Python scripting language. Jython allows scripts to be written that interact directly with Java classes. Specifically, jython is able to use compiled Java classes directly, allowing one to interactively call methods via a Java class's API on an instance of the class running in an application.

The JythonService has proved to be an invaluable tool during the development cycle of the application since it allows the user to interact directly with the application via its API.

Applications of in-situ drill head radar include utility mapping and location, roadway and bridge deck inspection, general obstacle detection and avoidance, concrete structure analysis, environmental site evaluation, geotechnical applications for civil engineers, geologists and geophysicists, archaeology, forensics, and research.

The object detection apparatus and methodology of the present invention may be advantageously employed in the field of horizontal directional drilling and geophysical evaluation and object identification. As such, the principles of the present invention may be employed together with the concepts, apparatuses, and methodologies discussed in commonly assigned U.S. Pat. Nos. 5,720,354, 5,904,210, 5,819,859, 5,553,407, 5,704,142, and 5,659,985, all of which are hereby included by reference in their entireties. For example, an exemplary approach for detecting an underground object and determining the range of the underground object is described in U.S. Pat. No. 5,867,117, which is hereby incorporated herein by reference in its entirety.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth and equivalents thereof.

We claim:

1. An apparatus for obstacle detection in an opaque material comprising:

at least one electromagnetic signal source adapted to produce an electromagnetic source signal suitable for transmission through said opaque material;

at least one electromagnetic signal detector adapted to receive reflected electromagnetic energy signals from discontinuities in said opaque material encountered by said electromagnetic source signal;

a reflected electromagnetic energy signal processor suitable for determining a presence of at least one of obstructions and strata variations within said opaque material; and a head element having a leading edge and a trailing edge, said head element suitable for traversing at least a portion of said opaque material, and said at least one electromagnetic signal source, said at least one electromagnetic signal detector and said at least one reflected electromagnetic energy signal processor disposed at least one of in contact with said head element and proximate to said head element.

2. An apparatus in accordance with claim 1, wherein said head element comprises a subterranean cutting tool.

3. An apparatus in accordance with claim 1, wherein said at least one electromagnetic signal source and said at least one electromagnetic signal detector are integrated into a transceiver.

4. An apparatus in accordance with claim 3, wherein said transceiver is integral with said head element.

5. An apparatus in accordance with claim 1, wherein said head element comprises a drill bit operably connected to a drill string, said drill string adapted to provide communication between said drill bit and a human machine interface device operably connected to an opposite end of said drill string.

6. An apparatus for obstacle detection in an opaque material comprising:

communication and radar controller means for controlling at least one radar module to enable capture of radar profiles;

sampler and controller means for controlling a radar transceiver and an antenna and sampling an intermediate frequency signal operably connected to said communication and radar controller means;

transmit synthesizer means for generating at least one radar transmit waveform operably connected to said sampler and controller means;

RF demodulation means for demodulating a received RF signal down to said intermediate frequency operably connected to said antenna and said sampler and controller means; and IF cancellation means for improving a dynamic range of said apparatus operably connected to said sampler and controller means.

7. An apparatus in accordance with claim 6, wherein said communication and radar controller means is operably connected to said sampler and controller means by a first radar module link, said sampler and controller means is operably connected to said transmit synthesizer means by a second radar module link, and said sampler and controller means is operably connected to said antenna by a third radar module link.

8. An apparatus in accordance with claim 6 further comprising a human machine interface operably connected to said communication and radar controller means.

9. An apparatus in accordance with claim 6, wherein said communications and radar controller means, said sampler and controller means, said transmit synthesizer means, said RF demodulator means, said IF cancellation means and said antenna are disposed within a head element suitable for traversing said opaque material.

10. An apparatus in accordance with claim 9, wherein said head element is a drill bit suitable for subterranean boring.

11. An apparatus in accordance with claim 8, wherein said human machine interface and said communications and radar controller means are operably connected to each other by wireless communications.

12. An apparatus in accordance with claim 7, wherein each of said radar module links comprises a low voltage differential signaling electrical interface.

13. An apparatus in accordance with claim 6, wherein said transmit synthesizer means and said RF demodulator means together constitute a radar transceiver.

14. An apparatus in accordance with claim 13, wherein said radar transceiver comprises separate transmit and receive synthesizers.

15. An apparatus in accordance with claim 6 further comprising a modulation scheme selected from the group consisting of stepped frequency continuous wave radar, impulse radar, frequency modulated continuous wave radar, and noise radar.

16. An apparatus comprising:

a controllable head element suitable for traversing an opaque material; and an obstacle avoidance system disposed one of in said controllable head element, on an outer surface of said controllable head element, and proximate said controllable head element, said obstacle avoidance system comprising a system selected from the group consisting of stepped frequency continuous wave radar, impulse radar, frequency modulated continuous wave radar and noise radar.

17. An apparatus in accordance with claim 16, wherein said obstacle avoidance system comprises said stepped frequency continuous wave radar system.

18. An apparatus in accordance with claim 17, wherein said stepped frequency continuous wave radar system comprises a communications and radar controller module, a sampler and controller module operably connected to said communications and radar controller module, and a radar transmitter module, a radar receiver module, an antenna module, an RF demodulator module and an IF cancellation module operably connected with said sampler and controller module.

19. An apparatus in accordance with claim 17 further comprising a human machine interface disposed distal from said controllable head element operably connected to said stepped frequency continuous wave radar system.

20. An apparatus in accordance with claim 18 further comprising at least one radar module link operably connected to at least one of said modules, thereby providing communications and a reference clock to all said modules.

21. An apparatus in accordance with claim 20, wherein said at least one radar module link comprises two low voltage differential signaling pairs, one bi-directional line and one clock line.

22. An apparatus in accordance with claim 20, wherein said at least one radar module link comprises a bi-directional, fair multiple-access, serial communication protocol operable with one clock and one data signal.

23. An apparatus in accordance with claim 18, wherein said antenna module comprises a surrounding media adaptable antenna.

* * * * *